US005578406A

United States Patent [19]

Ojima et al.

[11] Patent Number: 5,578,406

[45] Date of Patent: Nov. 26, 1996

[54] ELECTROPHOTOGRAPHIC PHOTORECEPTOR

[75] Inventors: Fumio Ojima; Tomoo Kobayashi; Toru Ishii; Kiyokazu Mashimo; Tomozumi Uesaka, all of Minami-ashigara, Japan

[73] Assignee: Fuji Xerox Co., Ltd., Tokyo, Japan

[21] Appl. No.: 517,348

[22] Filed: Aug. 21, 1995

[30] Foreign Application Priority Data

Aug. 23, 1994 [JP] Japan ..... 6-219598
Dec. 2, 1994 [JP] Japan ..... 6-324033

[51] Int. Cl.[6] ..... G03G 5/09

[52] U.S. Cl. ..... 430/83; 430/59; 430/96

[58] Field of Search ..... 430/83, 96, 59

[56] References Cited

U.S. PATENT DOCUMENTS

| | | | |
|---|---|---|---|
| 4,637,971 | 1/1987 | Takei et al. | 430/96 X |
| 5,332,635 | 7/1994 | Tanaka | 430/96 |
| 5,407,767 | 4/1995 | Nogami et al. | 430/83 X |

FOREIGN PATENT DOCUMENTS

| | | |
|---|---|---|
| 62-247374 | 10/1987 | Japan . |
| 63-148263 | 6/1988 | Japan . |
| 1-177551 | 7/1989 | Japan . |
| 2-254459 | 10/1990 | Japan . |
| 2-254458 | 10/1990 | Japan . |
| 2-57300 | 12/1990 | Japan . |
| 3-63651 | 3/1991 | Japan . |
| 3-150571 | 6/1991 | Japan . |
| 4-179961 | 6/1992 | Japan . |
| 5-3584 | 1/1993 | Japan . |
| 5-80548 | 4/1993 | Japan . |
| 5-142800 | 6/1993 | Japan . |

*Primary Examiner*—Roland Martin
*Attorney, Agent, or Firm*—Oliff & Berridge

[57] ABSTRACT

An electrophotographic photoreceptor is disclosed which comprises an electroconductive substrate and a photosensitive layer formed thereon, said photosensitive layer containing as a binder resin a copolycarbonate resin comprising a structural unit represented by formula (I)

(I)

and a structural unit represented by formula (II)

(II)

wherein X and X' each is hydrogen, a halogen, or methyl; R, a substituent, is hydroxyl, carboxyl, acetyl, or a $C_{1-4}$ alkyl; and j is 0 to 3 and further containing as a charge transport material a triarylamine compound represented by formula (III)

(III)

wherein $R_1$ is hydrogen or methyl; k is 1 or 2; and $Ar_1$ and $Ar_2$ each is an optionally substituted aryl.

8 Claims, 3 Drawing Sheets

ELECTROPHOTOGRAPHIC PHOTORECEPTOR

FIELD OF THE INVENTION

The present invention relates to an electrophotographic photoreceptor. More particularly, this invention relates to an electrophotographic photoreceptor which combines excellent electrical characteristics and mechanical strength over a prolonged period of time and can be stably produced.

BACKGROUND OF THE INVENTION

Electrophotography is used exceedingly widely in recent years in the fields of copiers, laser beam printers, facsimile telegraphs, etc., because this technology has an advantage that both high-speed printing and high print quality can be obtained. Widely known as electrophotographic photoreceptors for use in these electrophotographic apparatus are those employing an inorganic photoconductive material such as, e.g., selenium, a selenium-tellurium alloy, a selenium-arsenic alloy, or cadmium sulfide. On the other hand, investigations on electrophotographic photoreceptors employing an organic photoconductive material which have advantages of low cost and superiority in producibility and disposability over the electrophotographic photoreceptors employing such inorganic photoconductive materials are becoming intensive. Of these organic photoreceptors, the organic multilayer photoreceptors of the function separation type comprising a charge generating layer which generates charges upon exposure to light and a charge transport layer which transports the charges are superior in electrophotographic characteristics including sensitivity, electrification characteristics, and stability thereof in repeated use. Various organic photoreceptors of such multilayer type have been proposed and put to practical use.

Organic photoreceptors of the single-layer type not only are advantageous in producibility and production cost but have an advantage that they enable positively charging systems (ozone generation reduction, evenness of electrification). However, since the single-layer organic photoreceptors presently have a problem that they are inferior in electrical performances to multilayer photoreceptors, there is yet much room for investigations and developments.

Although some of the organic photoreceptors developed so far have sufficient performances concerning such electrophotographic characteristics, they have poor resistance to mechanical external force because they comprise organic photoconductive materials. Specifically, the photoreceptor surface undergoes wearing, marring, etc. due to direct loading by toner, developing agent, paper, and a cleaning member, and recently by a roll or another means which comes into direct contact with the photoreceptor to electrify it. In addition, undesirable deposition such as toner filming occurs on the photoreceptor surface. Such troubles on the photoreceptor surface cause the problem of image defects. Other problems are that the ozone, nitrogen oxide, etc. generated by corona discharge cause a deterioration of the surface layer of the photoreceptor, and that a paper dust released by receiving paper and other dust particles adhere to and accumulate on the photoreceptor surface to cause image diffusion in a high-humidity atmosphere. The service life of the photoreceptor is limited by these problems.

With the spread of digital copiers or printers, in which exposure is conducted with a semiconductor laser, photoreceptors have come to be required to have the maximum sensitivity within the near infrared wavelength region for the semiconductor laser (780–830 nm). Moreover, since the time necessary for one process consisting of charging, exposure, development, transfer, cleaning, and erase tends to become shorter with the trend toward color electrophotography, higher-speed processing, and size reduction, photoreceptors are also required to have both quicker response to light and long-term electrical stability. Thus, the photoreceptors have come to be used in a more complicated process under higher stresses, and are hence required to have even higher durability.

Various kinds of materials for use as binder resins for the photosensitive layers of these electrophotographic photoreceptors have conventionally been investigated. For example, use of various modified polycarbonate resins as a binder resin for a photoreceptor surface layer has been proposed (JP-B-2-57300, JP-A-62-247374, JP-A-63-148263, JP-A-1-177551, JP-A-2-254458, JP-A-2-254459, JP-A-3-63651, JP-A-3-150571, JP-A-4-179961, JP-B-5-3584, JP-A-5-80548, and JP-A-5-142800). (The terms "JP-A" and "JP-B" as used herein mean an "unexamined published Japanese patent application" and an "examined Japanese patent publication," respectively.)

Use of those proposed resins as a binder resin for a photosensitive layer yields electrophotographic photoreceptors having relatively satisfactory durability. However, this durability is still insufficient. Namely, the mechanical strength of coating films formed using those resins is not always sufficient, so that the surface of the photosensitive layer wears during long-term repeated use in a copier. As a result, the photoreceptor suffers a change in its film thickness, a decrease in electrification potential, and a change in sensitivity, resulting in copies having fogging or a reduced density. Furthermore, the surface marring of the photoreceptor causes image defects. On the other hand, even when a resin having better wearing resistance is used, its electrical characteristics are insufficient and use of such a resin having better abrasion resistance has a problem that undesirable deposition such as toner filming occurs to cause image defects. In addition, if a binder resin which is soluble only in low-boiling organic solvents such as methylene chloride and tetrahydrofuran is used for forming a photosensitive layer, application of the coating fluid containing this resin has problems that the coating film surface adsorbs moisture in the surrounding air to cause the phenomenon called blushing or to result in an orange-peel surface. Although a high-boiling organic solvent may be mixed in order to eliminate these problems, this causes the coating fluid to gel in an early stage, resulting in impaired production stability.

The compatibility of charge transport materials with binder resins is also important. It has been made clear that a charge transport material having insufficient compatibility partly undergoes crystallization, precipitation, etc. to produce a considerable influence on electrical characteristics and image quality. Even in the case of a combination having good compatibility as in a charge transport layer comprising a combination of the copolycarbonate disclosed in JP-B-5-3584 with a benzidine compound as a charge transport material, there is a drawback that image quality is impaired due to substances generated by electrical discharge for electrification. In addition, this charge transport layer, when used in electrophotographic apparatus employing a thinner drum and having a higher processing speed, is required to be further improved in electrical characteristics.

SUMMARY OF THE INVENTION

The present invention has been achieved in view of the circumstances described above. An object of the present invention is to provide an electrophotographic photoreceptor which has excellent producibility, i.e., a coating fluid used for forming the electrophotographic photoreceptor is stable and does not gel even with a high-boiling solvent, and which has improved wearing resistance and has been further improved in electrical characteristics and image-quality retention.

As a result of intensive studies made by the present inventors on photosensitive-layer materials, it has been found that by incorporating a special copolycarbonate resin as a binder resin and at least one triarylamine compound as a charge transport material, an electrophotographic photoreceptor improved in producibility, electrical characteristics, and image-quality retention and also having excellent wearing resistance can be obtained. The present invention has been achieved based on this finding.

The present invention provides an electrophotographic photoreceptor which comprises an electroconductive substrate coated with a photosensitive layer, said photosensitive layer containing as a binder resin a copolycarbonate resin comprising a repeating structural unit represented by formula

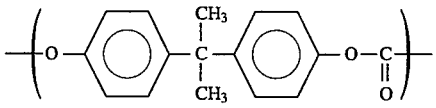

(I)

and a repeating structural unit represented by formula (II)

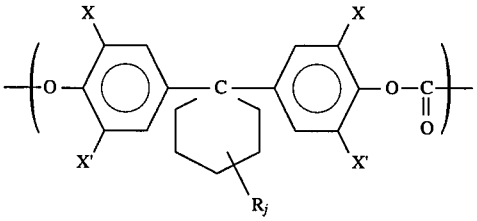

(II)

wherein X and X' each represents a hydrogen atom, a halogen atom, or a methyl group; R, which is a substituent, represents a hydroxyl group, a carboxyl group, an acetyl group, or an alkyl group having from 1 to 4 carbon atoms; and j means an integer of from 0 to 3, and further containing as a charge transport material at least one triarylamine compound represented by formula (III)

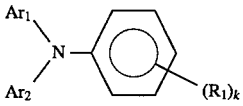

(III)

wherein $R_1$ represents a hydrogen atom or a methyl group; k means an integer of 1 or 2; and $Ar_1$ and $Ar_2$ each represents a substituted or unsubstituted aryl group, with the substituent(s) being a hydrogen atom, a halogen atom, an alkyl group, an alkoxy group, or a substituted amino group.

DETAILED DESCRIPTION OF THE INVENTION

Figure 1:
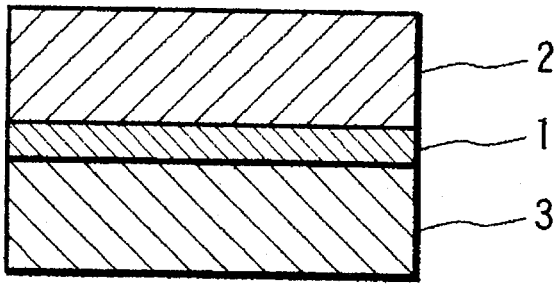
FIG. 1 is a diagrammatic sectional view of one embodiment of the electrophotographic photoreceptor according to the invention.
Figure 2:
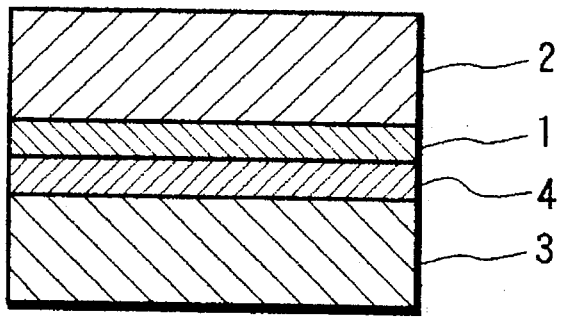
FIG. 2 is a diagrammatic sectional view of another embodiment of the electrophotographic photoreceptor according to the invention.
Figure 3:
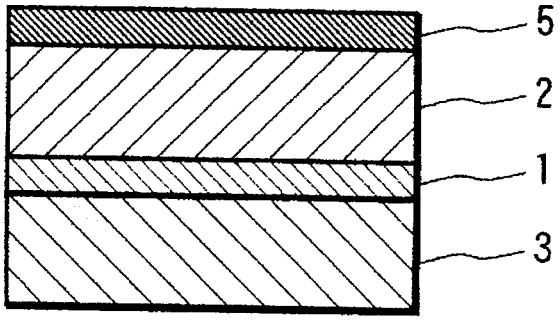
FIG. 3 is a diagrammatic sectional view of still another embodiment of the electrophotographic photoreceptor according to the invention.
Figure 4:
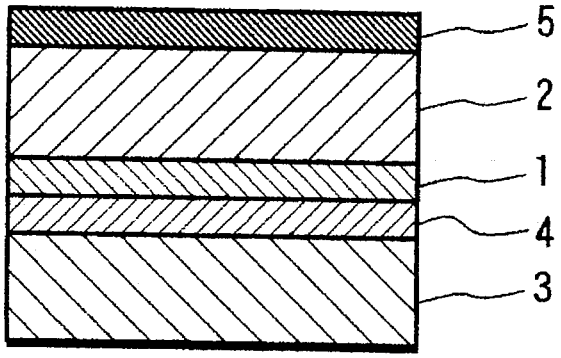
FIG. 4 is a diagrammatic sectional view of a further embodiment of the electrophotographic photoreceptor according to the invention.
Figure 5:
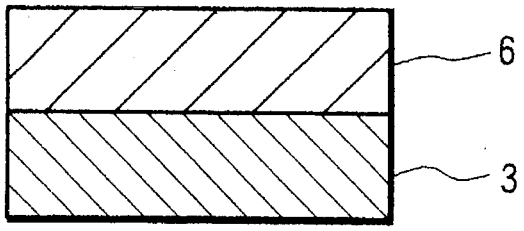
FIG. 5 is a diagrammatic sectional view of still a further embodiment of the electrophotographic photoreceptor according to the invention.
Figure 6:
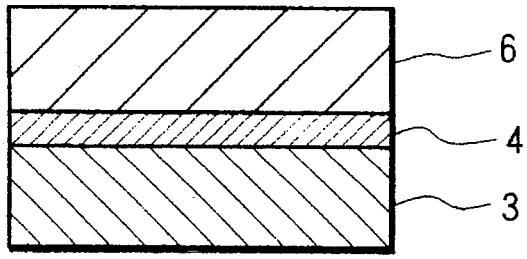
FIG. 6 is a diagrammatic sectional view of yet a further embodiment of the electrophotographic photoreceptor according to the invention.

Embodiments of the electrophotographic photoreceptor of the present invention are shown in FIGS. 1 to 6 as diagrammatic sectional views. FIGS. 1 to 4 each illustrates a photosensitive layer having a multilayer structure, while FIGS. 5 and 6 each illustrates a photosensitive layer having a single-layer structure. The embodiment shown in FIG. 1 comprises an electroconductive substrate 3 and, formed thereon, a charge generating layer 1 and a charge transport layer 2. The embodiment shown in FIG. 2 has an undercoat layer 4 formed on an electroconductive substrate 3. The embodiment shown in FIG. 3 has a protective layer (overcoat layer) 5 as the surface layer. The embodiment shown in FIG. 4 has an undercoat layer 4 and a protective layer 5. The embodiment shown in FIG. 5 has a photoconductive layer 6 formed on an electroconductive substrate 3. The embodiment shown in FIG. 6 has an undercoat layer 4 formed on an electroconductive substrate 3.

Examples of the electroconductive substrate include metals such as aluminum, nickel, chromium, and stainless steel, plastic or other films having deposited thereon a thin film of, e.g., aluminum, titanium, nickel, chromium, stainless steel, gold, vanadium, tin oxide, indium oxide, or ITO, and paper sheets and plastic or other films coated or impregnated with a conductivity-imparting agent. These electroconductive substrates may be used in a suitable form such as a drum, sheet, or plate form, but the substrate form is not limited thereto. If desired and necessary, the surface of the electroconductive substrate may be subjected to various treatments as long as such treatments do not adversely influence image quality. For example, the surface of the substrate may be subjected to anodic oxidation to form an oxide film thereon, oxidation with hot water, or a chemical treatment. The substrate surface may also be subjected to a coloring treatment or a treatment for irregular reflection, e.g., sandblasting.

An undercoat layer is preferably formed in this invention between the electroconductive substrate and the photosensitive layer. This undercoat layer not only serves to inhibit the injection of charges from the electroconductive substrate to the photosensitive layer which is in an electrified state, but also functions as an adhesive layer to bond and unite the photosensitive layer to the electroconductive substrate. In some cases, the undercoat layer also functions to prevent the reflection of light from the electroconductive substrate.

Examples of binder resins that can be used for forming this undercoat layer include known materials such as polyamide resins, vinyl chloride resins, vinyl acetate resins, phenolic resins, polyurethane resins, melamine resins, benzoguanamine resins, polyimide resins, polyethylene resins, polypropylene resins, polycarbonate resins, acrylic resins, methacrylic resins, vinylidene chloride resins, poly(vinyl acetal) resins, vinyl chloride-vinyl acetate copolymers, poly(vinyl alcohol) resins, water-soluble polyester resins, nitrocellulose, casein, gelatin, poly(glutamic acid), starch, starch acetate, amino starch, poly(acrylic acid), polyacrylamide, zirconium chelate compounds, titanyl chelate compounds, titanyl alkoxide compounds, organic titanyl compounds, and silane coupling agents. These materials may be used alone or as a mixture of two or more thereof.

Such binder resins may be used as a mixture with fine particles of titanium oxide, aluminum oxide, silicon oxide, zirconium oxide, barium titanate, a silicone resin, etc.

For forming the undercoat layer, an ordinary coating technique may be employed such as, e.g., blade coating, wire bar coating, spray coating, dip coating, bead coating, air-knife coating, or curtain coating.

The thickness of the undercoat layer is desirably from 0.01 to 10 μm, preferably from 0.05 to 2 μm.

The photosensitive layer formed on the electroconductive substrate in the electrophotographic photoreceptor of the present invention may have either a single-layer structure or a multilayer structure in which functions are allotted to a charge generating layer and a charge transport layer. These photosensitive layers each consists of one or more films each comprising a binder resin and contained therein a charge generating material or a charge transport material or both.

In the case of forming a photosensitive layer having a multilayer structure, the sequence of layer formation is not limited, and either of the charge generating layer and the charge transport layer may be the upper layer. However, explanations are made below mainly on cases where the charge transport layer is the upper layer.

The charge generating layer can be formed by the vacuum deposition of a charge generating material, or by dispersing a charge generating material into a binder resin in an organic solvent and applying the dispersion. Examples of the charge generating material for use in this invention include inorganic photoconductive materials such as particulate selenium-based photoconductive materials (e.g., amorphous selenium, crystalline selenium-tellurium alloys, selenium-arsenic alloys, other selenium compounds and alloys), particulate selenium, zinc oxide, and titanium oxide and organic pigments and dyes such as phthalocyanine compounds, squarylium compounds, particulate anthanthrone pigments, particulate perylene pigments, azo compounds, anthraquinone compounds, pyrene compounds, pyrylium salts, and thiapyrylium salts.

The particulate selenium-based photoconductive material preferably has a particle size of 0.01 μm to 1 μm, more preferably 0.03 μm to 0.3 μm.

The particulate anthanthrone pigment preferably has a particle size of 0.2 μm to 1 μm, more preferably around 0.5 μm.

The particulate perylene pigment preferably has a particle size of 0.1 μm to 1 μm, more preferably around 0.5 μm.

Preferred of those charge generating materials are phthalocyanine pigments, in particular, metal-free phthalocyanine, titanyl phthalocyanine, and gallium phthalocyanine. Photoreceptors employing these phthalocyanine pigments have high sensitivity in the near infrared wavelength region for a semiconductor laser (780–830 nm) and show stable electrical characteristics over long.

Figure 7:
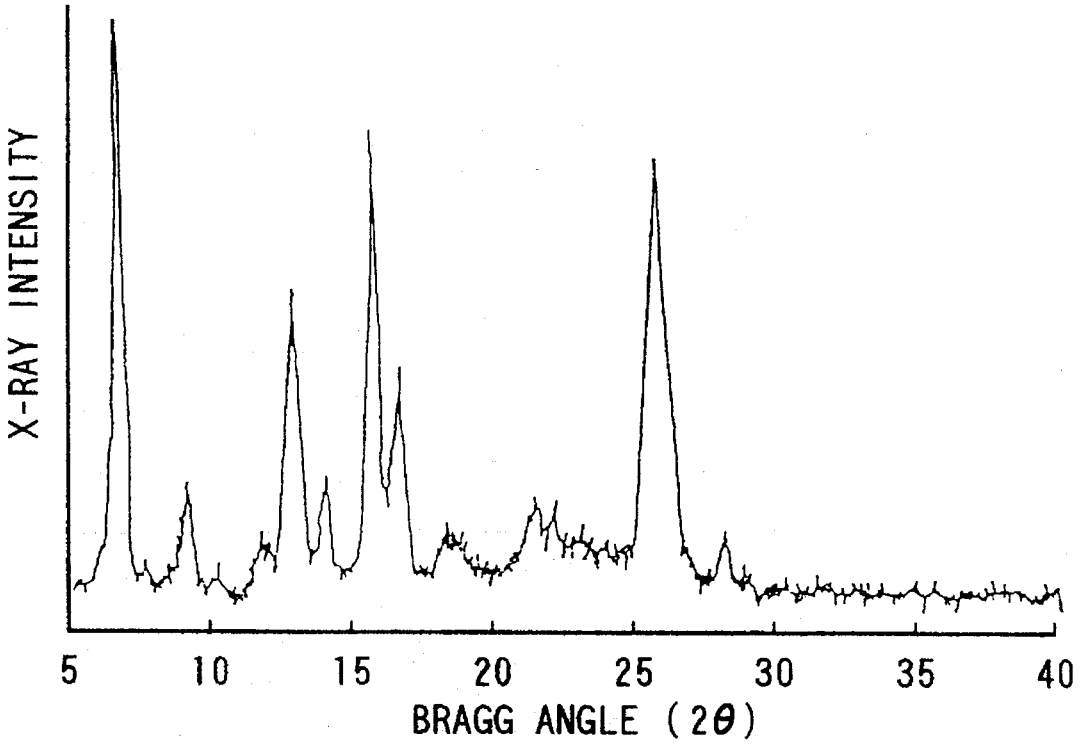
FIG. 7 is an X-ray diffraction spectrum (obtained with $CuK_\alpha$) of the gallium phthalocyanine powder used in Examples 21, 22, and 34.
Figure 8:
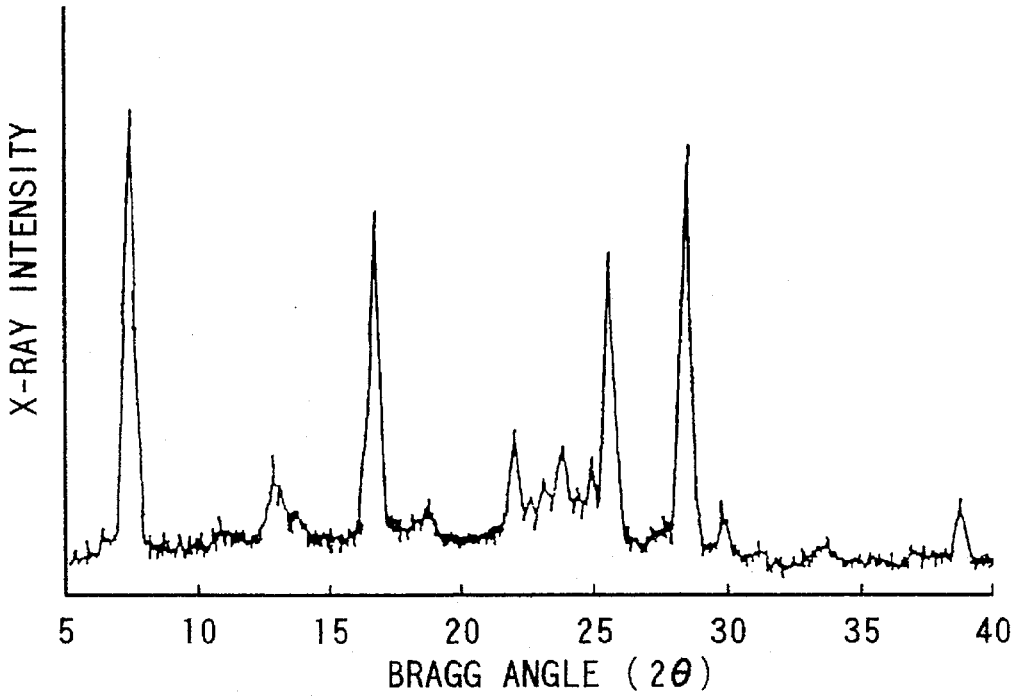
FIG. 8 is an X-ray diffraction spectrum (obtained with $CuK_\alpha$) of the chlorogallium phthalocyanine powder used in Examples 23, 24, 35, 40, and 42.

More specifically, examples of such preferred phthalocyanine pigments include the gallium phthalocyanine whose $CuK_{60}$ X-ray diffraction spectrum has intense diffraction peaks at Bragg angles (2θ±0.2°) of at least 6.8°, 12.8°, 15.8°, and 26.0° (see FIG. 7), the hydroxygallium phthalocyanine whose $CuK_{\alpha}$ X-ray diffraction spectrum has intense diffraction peaks at Bragg angles (2θ±0.2°) of at least 7.5°, 9.9°, 12.5°, 16.3°, 18.6°, 25.1°, and 28.3° (see FIG. 9), and the chlorogallium phthalocyanine whose $CuK_{\alpha}$ X-ray diffraction spectrum has intense diffraction peaks at Bragg angles (2θ±0.2°) of at least 7.4°, 16.6°, 25.5°, and 28.3° (see FIG. 8)

When used in the visible-light wavelength region, the anthanthrone pigments show stable electrical characteristics over long, while particulate selenium, in particular, particulate trigonal selenium, not only shows stable electrical characteristics over long but has high sensitivity.

Examples of the binder resin for use in the charge generating layer include poly(vinyl acetal) resins such as poly(vinyl butyral) resins, poly(vinyl formal) resins, and partially acetalized poly(vinyl acetal) resins in which part of the butyral groups have been modified with formal, acetoacetal, or similar groups, polyamide resins, polyester resins, modified ether type polyester resins, polycarbonate resins, acrylic resins, poly(vinyl chloride) resins, poly(vinylidene chloride) resins, polystyrene resins, poly(vinyl acetate) resins, vinyl chloride-vinyl acetate copolymers, silicone resins, phenolic resins, phenoxy resins, melamine resins, benzoguanamine resins, urea resins, polyurethane resins, poly(N-vinylcarbazole) resins, poly(vinylanthracene) resins, and poly(vinylpyrene). Of these, poly(vinyl acetal) resins, vinyl chloride-vinyl acetate copolymers, phenoxy resins, and modified ether type polyester resins are especially preferred in that the phthalocyanine pigments described above, anthanthrone pigments, and particulate trigonal selenium show good dispersibility in such resins. Namely, such preferred resins give pigmented coating fluids which are free from pigment aggregation and stable over long to form a homogeneous film, thereby improving electrical characteristics and diminishing image defects. However, any resins other than the above-enumerated examples are usable as long as they are capable of forming a film under ordinary conditions. These binder resins may be used alone or as a mixture of two or more thereof.

The proportion of the charge generating material to the binder resin is preferably from 10:1 to 1:10 by weight.

Examples of solvents that can be used for coating-fluid preparation include ordinarily employed organic solvents such as methanol, ethanol, n-propanol, n-butanol, benzyl alcohol, methyl Cellosolve, ethyl Cellosolve, acetone, methyl ethyl ketone, cyclohexanone, chlorobenzene, methyl acetate, n-butyl acetate, dioxane, tetrahydrofuran, methylene chloride, and chloroform. These solvents may be used alone or as a mixture of two or more thereof.

For applying the coating fluid, an ordinarily employed coating technique may be used such as, e.g., blade coating, wire bar coating, spray coating, dip coating, bead coating, air knife coating, or curtain coating. The thickness of the charge generating layer is generally from 0.01 to 5 μm, preferably from 0.1 to 2.0 μm. If the thickness thereof is smaller than 0.01 μm, it is difficult to evenly form the charge generating layer. If the thickness thereof exceeds 5 μm, electrophotographic characteristics tend to be significantly impaired.

Examples of the charge transport material contained in the charge transport layer include electron-attracting substances such as quinone compounds, e.g., p-benzoquinone, chloranil, bromanil, and anthraquinone, tetracyanoquinodimethane compounds, fluorenone compounds, e.g., 2,4,7-trinitrofluorenone, xanthone compounds, benzophenone compounds, cyanovinyl compounds, and ethylenic compounds and electron-withdrawing substances such as triarylamine compounds, benzidine compounds, arylalkane compounds, aryl-substituted ethylenic compound, stilbene compounds, anthracene compounds, hydrazone compounds, and polymers having, in the main chain or a side chain thereof, a group derived from any of these electron-withdrawing compounds. These charge transport materials may be used alone or as a mixture of two or more thereof.

Especially preferred of these charge transport materials are triarylamine compounds. In some cases, the triarylamine compounds are preferably used as a mixture with a benzidine compound.

Preferred triarylamine compounds are those represented by the following formula (III)

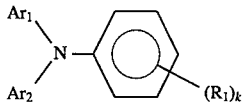

(III)

wherein $R_1$ represents a hydrogen atom or a methyl group; k represents an integer of 1 or 2; and $Ar_1$ and $Ar_2$ each represents a substituted or unsubstituted aryl group, with the substituent(s) being a hydrogen atom, a halogen atom, an alkyl group, an alkoxy group, or a substituted amino group.

The aryl group in $Ar_1$ and $Ar_2$ preferably has about 4 to 20 carbon atoms.

The alkyl group as a substituent for the aryl group in $Ar_1$ and $Ar_2$ preferably has 1 to 4 carbon atoms.

The alkoxy group as a substituent for the aryl group in $Ar_1$ and $Ar_2$ preferably has 1 to 4 carbon atoms, and include a halogen-substituted alkoxy group.

The substituted amino group as a substituent for the aryl group in $Ar_1$ and $Ar_2$ is preferably represented by $—NR_2$, wherein R represents an alkyl group having 1 to 4 carbon atoms.

Preferred benzidine compounds are those represented by the following formula (IV)

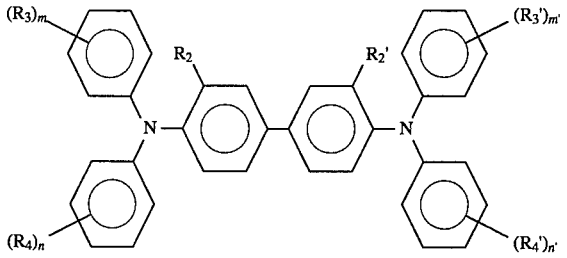

wherein $R_2$ and $R_2'$ are the same or different and each represents a hydrogen atom, an alkyl group, an alkoxy group, or a halogen atom; $R_3$, $R_3'$, $R_4$, and $R_4'$ are the same or different and each represents a hydrogen atom, an alkyl group, an alkoxy group, a halogen atom, or a substituted amino group; and m, m', n, and n' each represents an integer of 1 or 2.

The alkyl group in $R_2$ and $R_2$40 preferably has 1 to 4 carbon atoms.

The alkoxy group in $R_2$ and $R_2'$ preferably has 1 to 4 carbon atoms.

The alkyl group in $R_3$, $R_3'$, $R_4$ and $R_4'$ preferably has 1 to 4 carbon atoms.

The alkoxy group in $R_3$, $R_3'$, $R_1$ and $R_4'$ preferably has 1 to 4 carbon atoms.

The substituted amino group in $R_3$, $R_3'$, $R_4$ and $R_4'$ is preferably represented by $—NR'_2$, wherein R' represents an alkyl group having 1 to 4 carbon atoms.

Examples of such triarylamine compounds are given in Tables 1 to 4, and examples of such benzidine compounds are given in Tables 5 and 6.

TABLE 1

| | $R_1$ | $Ar_1$ | $Ar_2$ |
|---|---|---|---|
| III-1 | 4-$CH_3$ | 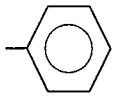 | 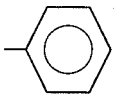 |
| III-2 | 3-$CH_3$, 4-$CH_3$ | | |
| III-3 | 4-$CH_3$ | 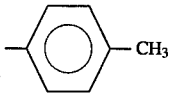 | 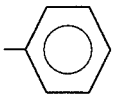 |
| III-4 | 3-$CH_3$, 4-$CH_3$ | | |
| III-5 | 4-$CH_3$ | 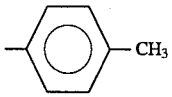 | 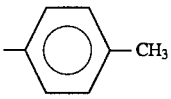 |
| III-6 | 3-$CH_3$, 4-$CH_3$ | | |
| III-7 | 4-$CH_3$ | 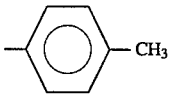 | 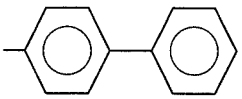 |
| III-8 | 3-$CH_3$, 4-$CH_3$ | | |
| III-9 | 4-$CH_3$ | 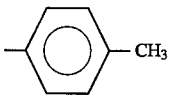 | 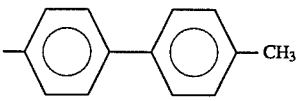 |
| III-10 | 3-$CH_3$, 4-$CH_3$ | | |

TABLE 1-continued
| | $R_1$ | $Ar_1$ | $Ar_2$ |
|---|---|---|---|
| III-11<br>III-12 | 4-$CH_3$<br>3-$CH_3$, 4-$CH_3$ | 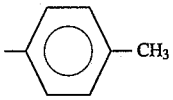 | 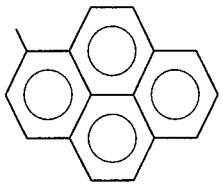 |
| III-13<br>III-14 | 4-$CH_3$<br>3-$CH_3$, 4-$CH_3$ | 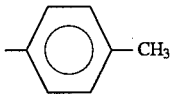 | 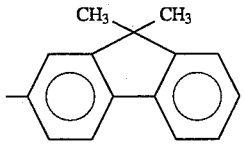 |
| III-15<br>III-16 | 4-$CH_3$<br>3-$CH_3$, 4-$CH_3$ | 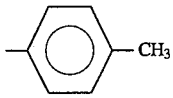 | 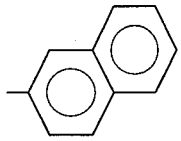 |
| III-17<br>III-18 | 4-$CH_3$<br>3-$CH_3$, 4-$CH_3$ | 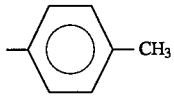 | 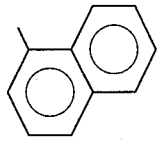 |
| III-19<br>III-20 | 4-$CH_3$<br>3-$CH_3$, 4-$CH_3$ | 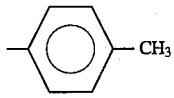 | 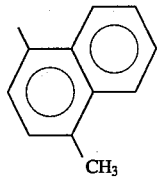 |
TABLE 2
| | $R_1$ | $Ar_1$ | $Ar_2$ |
|---|---|---|---|
| III-21<br>III-22 | 4-$CH_3$<br>3-$CH_3$, 4-$CH_3$ | 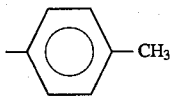 | 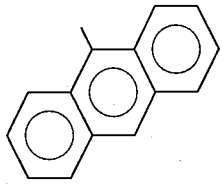 |
| III-23<br>III-24 | 4-$CH_3$<br>3-$CH_3$, 4-$CH_3$ | 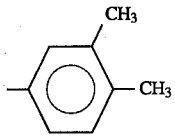 | 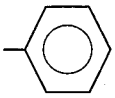 |
| III-25<br>III-26 | 4-$CH_3$<br>3-$CH_3$, 4-$CH_3$ | 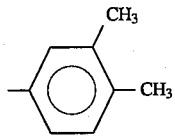 | 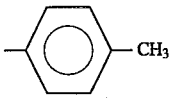 |

TABLE 2-continued
| | $R_1$ | $Ar_1$ | $Ar_2$ |
|---|---|---|---|
| III-27<br>III-28 | 4-$CH_3$<br>3-$CH_3$, 4-$CH_3$ | 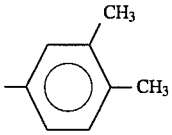 | 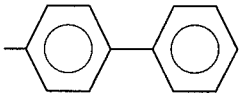 |
| III-29<br>III-30 | 4-$CH_3$<br>3-$CH_3$, 4-$CH_3$ | 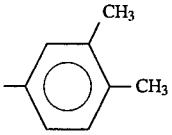 | 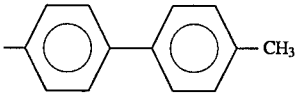 |
| III-31<br>III-32 | 4-$CH_3$<br>3-$CH_3$, 4-$CH_3$ | 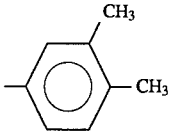 | 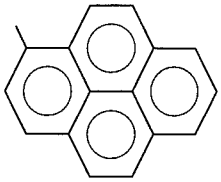 |
| III-33<br>III-34 | 4-$CH_3$<br>3-$CH_3$, 4-$CH_3$ | 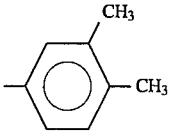 | 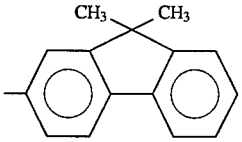 |
| III-35<br>III-36 | 4-$CH_3$<br>3-$CH_3$, 4-$CH_3$ | 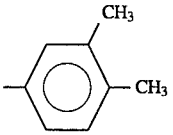 | 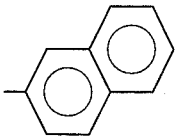 |
| III-37<br>III-38 | 4-$CH_3$<br>3-$CH_3$, 4-$CH_3$ | 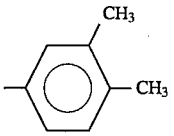 | 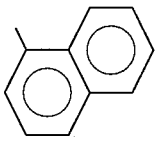 |
| III-39<br>III-40 | 4-$CH_3$<br>3-$CH_3$, 4-$CH_3$ | 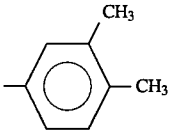 | 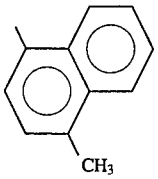 |
TABLE 3
| | $R_1$ | $Ar_1$ | $Ar_2$ |
|---|---|---|---|
| III-41<br>III-42 | 4-$CH_3$<br>3-$CH_3$, 4-$CH_3$ | 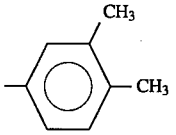 | 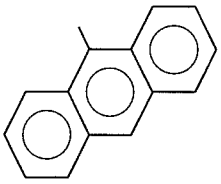 |

TABLE 3-continued
| | $R_1$ | $Ar_1$ | $Ar_2$ |
|---|---|---|---|
| III-43<br>III-44 | 4-$CH_3$<br>3-$CH_3$, 4-$CH_3$ | 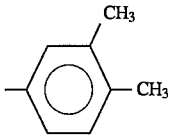 | 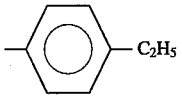 |
| III-45<br>III-46 | 4-$CH_3$<br>3-$CH_3$, 4-$CH_3$ | 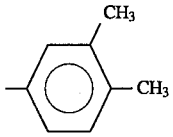 | 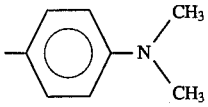 |
| III-47<br>III-48 | 4-$CH_3$<br>3-$CH_3$, 4-$CH_3$ | 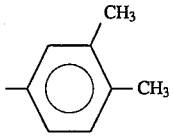 | 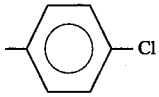 |
| III-49<br>III-50 | 4-$CH_3$<br>3-$CH_3$, 4-$CH_3$ | 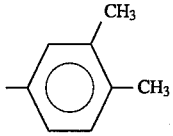 | 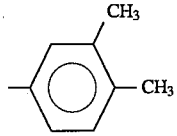 |
| III-51<br>III-52 | 4-$CH_3$<br>3-$CH_3$, 4-$CH_3$ | 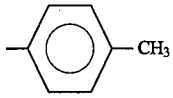 | 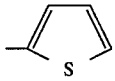 |
| III-53<br>III-54 | 4-$CH_3$<br>3-$CH_3$, 4-$CH_3$ | 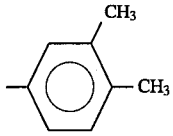 | 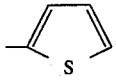 |
| III-55<br>III-56 | 4-$CH_3$<br>3-$CH_3$, 4-$CH_3$ | 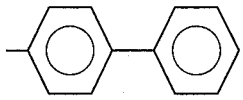 | 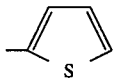 |
| III-57<br>III-58 | 4-$CH_3$<br>3-$CH_3$, 4-$CH_3$ | 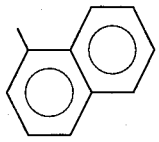 | 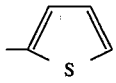 |
| III-59<br>III-60 | 4-$CH_3$<br>3-$CH_3$, 4-$CH_3$ | 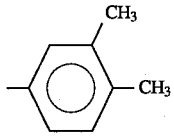 | 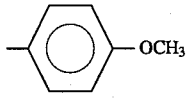 |
| III-61<br>III-62 | 4-$CH_3$<br>3-$CH_3$, 4-$CH_3$ | 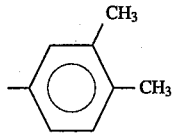 | 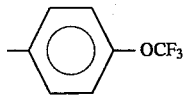 |

TABLE 4

| | $R_1$ | $Ar_1$ | $Ar_2$ |
|---|---|---|---|
| III-63<br>III-64 | 4-$CH_3$<br>3-$CH_3$, 4-$CH_3$ | 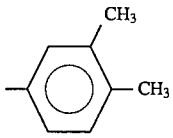 | 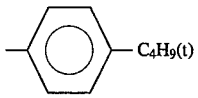 |
| III-65<br>III-66 | 4-$CH_3$<br>3-$CH_3$, 4-$CH_3$ | 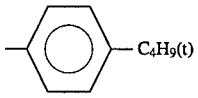 | 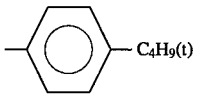 |
| III-67<br>III-68 | 4-$CH_3$<br>3-$CH_3$, 4-$CH_3$ | 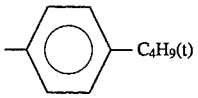 | 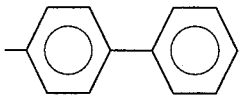 |
| III-69<br>III-70 | 4-$CH_3$<br>3-$CH_3$, 4-$CH_3$ | 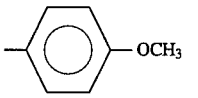 | 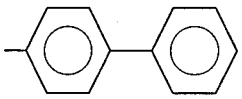 |

TABLE 5

| | $R_2$, $R_2'$ | $R_3$, $R_3'$ | $R_4$, $R_4'$ | | $R_2$, $R_2'$ | $R_3$, $R_3'$ | $R_4$, $R_4'$ |
|---|---|---|---|---|---|---|---|
| IV-1 | $CH_3$ | H | H | IV-16 | $CH_3$ | 4-$C_2H_5$ | 3,4-$CH_3$ |
| IV-2 | $CH_3$ | 2-$CH_3$ | H | IV-17 | $CH_3$ | 4-$C_3H_7$ | 3-$CH_3$ |
| IV-3 | $CH_3$ | 3-$CH_3$ | H | IV-18 | $CH_3$ | 4-$C_3H_7$ | 4-$CH_3$ |
| IV-4 | $CH_3$ | 4-$CH_3$ | H | IV-19 | $CH_3$ | 4-$C_4H_9$ | 3-$CH_3$ |
| IV-5 | $CH_3$ | 4-$CH_3$ | 2-$CH_3$ | IV-20 | $CH_3$ | 4-$C_4H_9$ | 4-$CH_3$ |
| IV-6 | $CH_3$ | 4-$CH_3$ | 3-$CH_3$ | IV-21 | $CH_3$ | 4-$C_2H_5$ | 4-$C_2H_5$ |
| IV-7 | $CH_3$ | 4-$CH_3$ | 4-$CH_3$ | IV-22 | $CH_3$ | 4-$C_2H_5$ | 4-$OCH_3$ |
| IV-8 | $CH_3$ | 3,4-$CH_3$ | H | IV-23 | $CH_3$ | 4-$C_3H_7$ | 4-$C_3H_7$ |
| IV-9 | $CH_3$ | 3,4-$CH_3$ | 3,4-$CH_3$ | IV-24 | $CH_3$ | 4-$C_3H_7$ | 4-$OCH_3$ |
| IV-10 | $CH_3$ | 4-$C_2H_5$ | H | IV-25 | $CH_3$ | 4-$C_4H_9$ | 4-$C_4H_9$ |
| IV-11 | $CH_3$ | 4-$C_3H_7$ | H | IV-26 | $CH_3$ | 4-$C_4H_9$ | 4-$OCH_3$ |
| IV-12 | $CH_3$ | 4-$C_4H_9$ | H | IV-27 | H | 3-$CH_3$ | H |
| IV-13 | $CH_3$ | 4-$C_2H_5$ | 2-$CH_3$ | IV-28 | H | 4-$CH_3$ | 4-$C_2H_5$ |
| IV-14 | $CH_3$ | 4-$C_2H_5$ | 3-$CH_3$ | IV-29 | H | 4-$C_2H_5$ | H |
| IV-15 | $CH_3$ | 4-$C_2H_5$ | 4-$CH_3$ | IV-30 | Cl | H | H |

TABLE 6

| | $R_2$, $R_2'$ | $R_3$, $R_3'$ | $R_4$, $R_4'$ | | $R_2$, $R_2'$ | $R_3$, $R_3'$ | $R_4$, $R_4'$ |
|---|---|---|---|---|---|---|---|
| IV-31 | Cl | 2-$CH_3$ | H | IV-45 | $OCH_3$ | H | H |
| IV-32 | Cl | 3-$CH_3$ | H | IV-46 | $OCH_3$ | 2-$CH_3$ | H |
| IV-33 | Cl | 4-$CH_3$ | H | IV-47 | $OCH_3$ | 3-$CH_3$ | H |
| IV-34 | Cl | 4-$CH_3$ | 2-$CH_3$ | IV-48 | $OCH_3$ | 4-$CH_3$ | H |
| IV-35 | Cl | 4-$CH_3$ | 3-$CH_3$ | IV-49 | $OCH_3$ | 4-$CH_3$ | 4-$CH_3$ |
| IV-36 | Cl | 4-$CH_3$ | 4-$CH_3$ | IV-50 | $OCH_3$ | 4-$C_2H_5$ | 4-$CH_3$ |
| IV-37 | $C_2H_5$ | H | H | IV-51 | $OCH_3$ | 4-$C_3H_7$ | 4-$CH_3$ |
| IV-38 | $C_2H_5$ | 2-$CH_3$ | H | IV-52 | $OCH_3$ | 4-$C_4H_9$ | 4-$CH_3$ |
| IV-39 | $C_2H_5$ | 3-$CH_3$ | H | IV-53 | $CH_3$ | 2-$N(CH_3)_2$ | H |
| IV-40 | $C_2H_5$ | 4-$CH_3$ | H | IV-54 | $CH_3$ | 3-$N(CH_3)_2$ | H |
| IV-41 | $C_2H_5$ | 4-$CH_3$ | 4-$CH_3$ | IV-55 | $CH_3$ | 4-$N(CH_3)_2$ | H |
| IV-42 | $C_2H_5$ | 4-$C_2H_5$ | 4-$CH_3$ | IV-56 | $CH_3$ | 4-Cl | H |
| IV-43 | $C_2H_5$ | 4-$C_3H_7$ | 4-$CH_3$ | IV-57 | H | 3,4-$CH_3$ | H |
| IV-44 | $C_2H_5$ | 4-$C_4H_9$ | 4-$CH_3$ | | | | |

The triarylamine compounds should not be construed as being limited to those enumerated in Tables 1 to 4. The triarylamine compounds may be used alone or as a mixture of two or more thereof.

In the case of using such triarylamine compounds as a mixture with one or more benzidine compounds, the benzidine compounds are not limited to those enumerated in Tables 5 and 6. For example, $R_2$ and $R_2'$, $R_3$ and $R_3'$, and $R_4$ and $R_4'$ each need not be the same as each other, although benzidine compounds in which $R_2$ and $R_2'$, $R_3$ and $R_3'$, and $R_4$ and $R_4'$ are the same as each other are shown in Tables 5 and 6 for convenience. Furthermore, the positions of $R_2'$, $R_3'$, and $R_4'$ may not be the same as those of $R_2$, $R_3$, and $R_4$, respectively.

The binder resin used in the charge transport layer comprises a copolycarbonate resin comprising a repeating structural unit represented by the following formula (I)

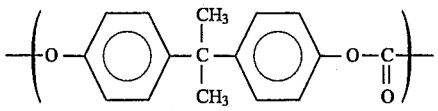

(I)

and a repeating structural unit represented by the following formula (II)

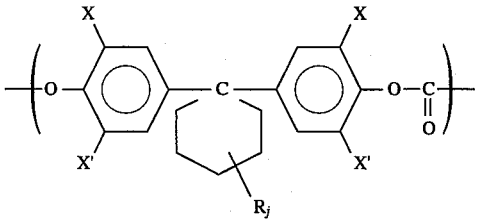

(II)

wherein X represents a hydrogen atom, a halogen atom, or a methyl group; R, which is a substituent, represents a hydroxyl group, a carboxyl group, an acetyl group, or an alkyl group having from 1 to 4 carbon atoms; and j represents an integer of from 0 to 3.

Examples of X and X' in formula (II) include fluorine, chlorine, bromine, and iodine as a halogen atom, and methyl as an alkyl group.

In the present invention, the copolycarbonate resin comprising repeating structural units represented by formulae (I) and (II) described above may be one having a viscosity-average molecular weight of from 10,000 to 200,000. In the case of using a copolycarbonate resin having a relatively narrow molecular weight distribution, its viscosity-average molecular weight is preferably from 20,000 to 100,000. If the viscosity-average molecular weight of the copolycarbonate resin is smaller than 10,000, the viscosity of the coating fluid obtained using this resin is so low that a necessary film thickness cannot be obtained and application of this coating fluid by dip coating results in unevenness of film thickness. If the viscosity-average molecular weight thereof is from 10,000 to 20,000, a coating film having insufficient mechanical strength and poor wearing resistance results. If the viscosity-average molecular weight thereof exceeds 200,000, the coating fluid obtained using this resin has too high a viscosity, so that it is difficult to obtain a desired film thickness. These problems are eliminated by using a mixture in an appropriate proportion of copolycarbonate resins of the above-described kind each having a viscosity-average molecular weight of from 10,000 to 200,000. Namely, copolycarbonate resins of the above-described kind which have different viscosity-average molecular weights may be used as a mixture thereof. The copolycarbonate resin described above may also be used as a mixture or copolymer with another kind of polycarbonate resin, as long as the functions and effects of the specific copolycarbonate resin are not adversely influenced thereby.

Preferred examples of the polycarbonate resin represented by formula (II) include the following.

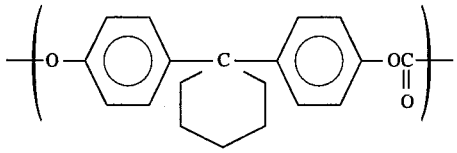

(II-1)

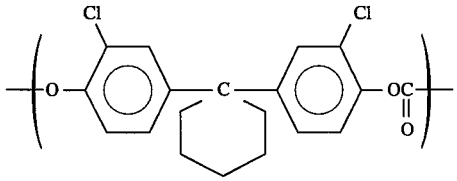

(II-2)

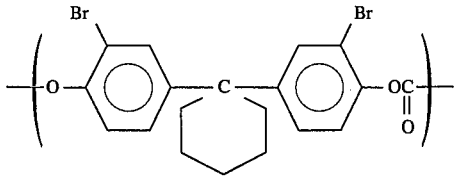

(II-3)

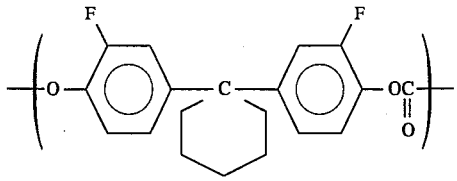

(II-4)

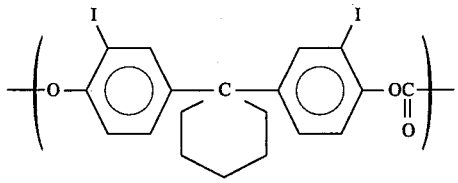

(II-5)

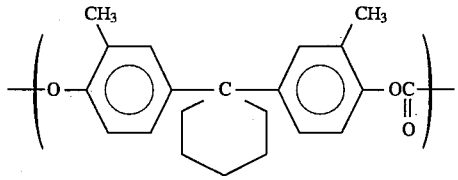

(II-6)

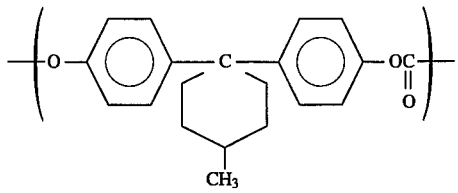

(II-7)

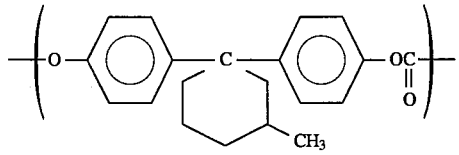

(II-8)

-continued (II-9)

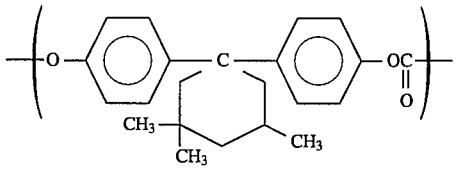

(II-10)

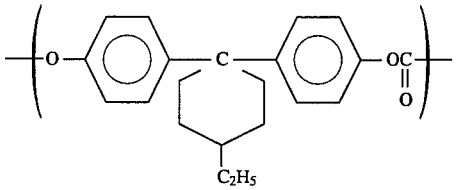

(II-11)

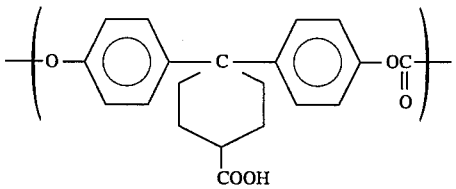

(II-12)

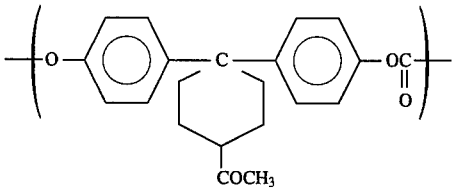

Of these polycarbonate resins, (II-1) and (II-6) are especially preferred. These polycarbonate resins can be produced by an ordinary synthesis process in which phenol compounds respectively represented by the following formulae (I') and (II') are reacted with phosgene.

(I')

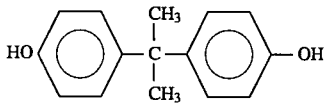

(II')

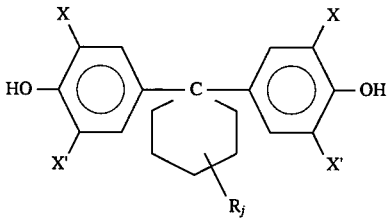

In formula (II'), X and X' each represents a hydrogen atom, a halogen atom, or a methyl group; R, which is a substituent, represents a halogen atom, a hydroxyl group, a carboxyl group, an acetyl group, or an alkyl group having from 1 to 4 carbon atoms; and j represents an integer of from 0 to 3.

For copolymerizing these two or more phenol compounds described above, use may be made, for example, of (1) a method in which all the phenol compounds are first reacted with phosgene simultaneously, (2) a method in which one phenol compound is reacted first and the other phenol compound is added thereto after a while and reacted, and (3) a method in which the phenol compounds are separately reacted with phosgene to obtain oligomers, which are then mixed together and reacted. Although any of these methods can be selected, method (1) is desirable in this invention for the following reasons. Since the number of steps contained in method (1) is smaller than in methods (2) and (3) and the synthesis process in method (1) can be carried out in an ordinary easy manner, the desired resin can be produced at a lower cost in method (1). Another reason is as follows. Bisphenol A, represented by formula (I'), may cause crystallization due to its high crystallizability and has a drawback that it is sparingly soluble in solvents other than low-boiling organic solvents. The resins synthesized by methods (2) and (3) are a block copolymer in which the bisphenol A block retains these drawbacks, so that the resins obtained by methods (2) and (3), of course, tend to have these drawbacks. In contrast, since the monomers in method (1) are randomly copolymerized, the resin thus obtained is an amorphous polymer which is free from the crystallizability of bisphenol A and has greatly improved solubility in high-boiling solvents. Consequently, method (1) is desirable.

In the copolycarbonate resin for use in this invention, the effective range of the proportion of the repeating structural unit represented by formula (I) to the repeating structural unit represented by formula (II) is from 1:19 to 19:1, preferably from 1:9 to 4:1, in terms of (I):(II) molar ratio.

In the charge transport layer in the electrophotographic photoreceptor of the present invention, the proportion of the charge transport material to the binder resin is desirably from 10:90 to 70:30, especially preferably from 30:70 to 60:40, by weight.

Examples of solvents that can be used for forming the charge transport layer include ordinary organic solvents such as aromatic hydrocarbons, e.g., benzene, toluene, and xylene, halogenated aromatic hydrocarbons, e.g., chlorobenzene, ketones, e.g., acetone and methyl ethyl ketone, halogenated aliphatic hydrocarbons such as methylene chloride, chloroform, and ethylene chloride, and cyclic or linear ethers, e.g., tetrahydrofuran and ethyl ether. These solvents may be used alone or as a mixture of two or more thereof.

For applying the coating fluid, an ordinary coating technique may be used such as, e.g., blade coating, wire bar coating, spray coating, dip coating, bead coating, air knife coating, or curtain coating.

The thickness of the charge transport layer used in this invention is generally from 5 to 70 μm, preferably from 10 to 50 μm. Thicknesses thereof smaller than 5 μm tend to result in a reduced initial electrification potential, while thicknesses thereof exceeding 70 μm tend to result in impaired electrophotographic characteristics and reduced image quality.

Additives such as an antioxidant, a light stabilizer, and a heat stabilizer may be incorporated into the photosensitive layer for the purpose of preventing the photoreceptor from being deteriorated by the ozone or any oxidizing gas generated in the copier or by light or heat.

Examples of the antioxidant include hindered phenols, hindered amines, p-phenylenediamine, arylalkanes, hydroquinone, spirochroman, spiroindanone, derivatives of these compounds, organosulfur compounds, and organophosphorus compounds. Examples of the light stabilizer include benzophenone, benzotriazole, dithiocarbamates, tetramethylpiperidine, and derivatives thereof.

In the case where the photosensitive layer in the electrophotographic photoreceptor of the present invention has a single-layer structure, the same charge generating and charge transport materials as in the photosensitive layer having a multilayer structure are used along with, as a binder resin, the copolycarbonate resin described hereinabove with regard to the charge transport layer. The copolycarbonate resin may contain any of the binder resins enumerated hereinabove with regard to the charge generating layer, in an amount less than 50% by weight. If desired and necessary, additives including an antioxidant such as those enumerated above, a light stabilizer such as those enumerated above, and a heat stabilizer may be incorporated into the photosensitive layer.

In the single-layer photoreceptor, the proportion of the charge generating material is desirably from 0.1 to 20% by weight, preferably from 0.5 to 5% by weight, based on the sum of the charge transport material and the binder resin. The proportion of the charge transport material to the binder resin is preferably from 60:40 to 30:70 by weight.

For forming the photosensitive layer on an electroconductive substrate, use may be made of a method comprising homogeneously dissolving or dispersing the above-described ingredients into a solvent such as those enumerated hereinabove with regard to the formation of a charge transport layer, applying the coating fluid by an ordinary coating technique such as those mentioned hereinabove, and then drying the coating. The thickness of the single-layer photoreceptor is generally from 5 to 70 μm, preferably from 10 to 40 μm.

A protective layer may be formed in the electrophotographic photoreceptor according to the present invention. In the case where the photoreceptor is of the single-layer type, the protective layer is formed on the photosensitive layer. When the photoreceptor is of the multilayer type, the protective layer is formed on the charge transport layer.

The present invention will be explained below in more detail by reference to Examples, but the invention should not be construed as being limited thereto. In the following Examples and Comparative Examples, all "parts" are by weight.

EXAMPLE 1

A solution consisting of 10 parts of a zirconium compound (Orgatics ZC540, manufactured by Matsumoto Seiyaku K.K., Japan), 1 part of a silane compound (A1110, manufactured by Nippon Unicar Co., Ltd., Japan), 40 parts of isopropanol, and 20 parts of butanol was applied to an aluminum substrate by dip coating. The coating was dried by heating at 150° C. for 10 minutes to form an undercoat layer having a thickness of 0.1 μm.

A mixture of 1 part of titanyl phthalocyanine as a charge generating material, 1 part of a poly(vinyl acetal) type poly(vinyl butyral) resin (S-Lec BM-S, manufactured by Sekisui Chemical Co., Ltd., Japan), and 100 parts of cyclohexanone was subjected to a dispersion treatment with a sand mill for 1 hour together with glass beads. The coating fluid obtained was applied to the undercoat layer by dip coating and dried by heating at 100° C. for 10 minutes to form a charge generating layer having a thickness of 0.2 μm.

Subsequently, a coating fluid obtained by dissolving 12 parts of a copolycarbonate represented by the following formula (A-1) (viscosity-average molecular weight, 45,400; manufactured by Mitsubishi Gas Chemical Company, Inc., Japan) and 8 parts of triarylamine compound III-28 specified hereinabove as a charge transport material into 100 parts of monochlorobenzene was applied to the charge generating layer. The coating was dried by heating at 115° C. for 60 minutes to form a charge transport layer having a thickness of about 20 μm. The states of the coating fluid and the coating film were visually examined.

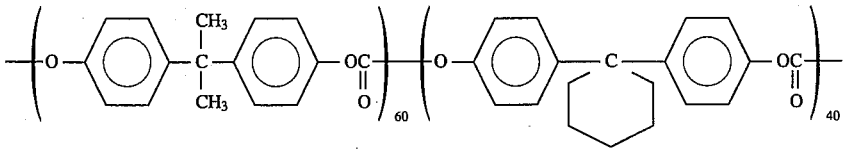

(A-1)

The electrophotographic photoreceptor thus produced was examined for electrophotographic characteristics as follows.

Using an electrostatic copying paper tester (Electrostatic Analyzer EPA-8100, manufactured by Kawaguchi Denki Seisakusho K.K., Japan), the electrophotographic photoreceptor was charged by means of −6 kV corona discharge in an ordinary-temperature ordinary-humidity atmosphere (20° C., 40% RH). Thereafter, 800-nm monochromatic light was separated from tungsten lamp light with a monochromator and allowed to strike upon the photoreceptor at an irradiance of 1 μW/cm$^2$ as measured on the photoreceptor surface. After the initial surface potential $V_0$ (volt) and half decay exposure $E_{1/2}$ (erg/cm$^2$) of the photoreceptor were determined, the photoreceptor was exposed to white light at 10 lx for 1 second to measure the residual potential $V_{RP}$ (volt). The charging and exposure described above were repeated 1,000 times, and the $V_0$, $E_{1/2}$, and $V_{RP}$ were then determined. The results obtained are shown in Table 7.

Comparative Example 1

An attempt was made to produce an electrophotographic photoreceptor in the same manner as in Example 1, except that a polycarbonate resin represented by the following formula (C) (viscosity-average molecular weight, 40,000; manufactured by Mitsubishi Gas Chemical Company, Inc.) was used in place of the copolycarbonate resin represented by formula (A-1) used in Example 1 for forming a charge transport layer. However, the polycarbonate resin represented by formula (C) did not dissolve in monochlorobenzene and failed to give a coating fluid. Because of this, an electrophotographic photoreceptor could not be produced.

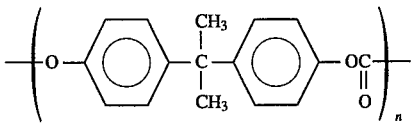

(C)

Comparative Example 2

An attempt was made to produce an electrophotographic photoreceptor in the same manner as in Example 1, except that a mixture of 7.2 parts by weight of the polycarbonate resin represented by formula (C) given above and 4.8 parts by weight of a polycarbonate resin represented by the following formula (D) (viscosity-average molecular weight, 39,000; manufactured by Mitsubishi Gas Chemical Company, Inc.) was used in place of the copolycarbonate resin represented by formula (A-1) used in Example 1 for forming a charge transport layer. However, the polycarbonate resin represented by formula (C) did not dissolve in monochlorobenzene as in Comparative Example 1 and failed to give a coating fluid. Because of this, an electrophotographic photoreceptor could not be produced.

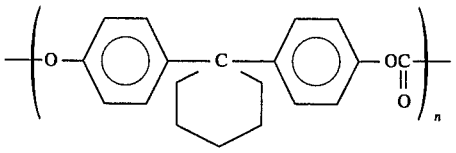

(D)

Comparative Example 3

An electrophotographic photoreceptor was produced and tested in the same manner as in Example 1, except that a copolycarbonate resin represented by the following structural formula (E) (viscosity-average molecular weight, 50,000; manufactured by Idemitsu Kosan Co., Ltd., Japan) was used in place of the copolycarbonate resin represented by formula (A-1) used in Example 1 for forming a charge transport layer. The results obtained are shown in Table 7. The coating fluid gelled 25 days after the preparation thereof.

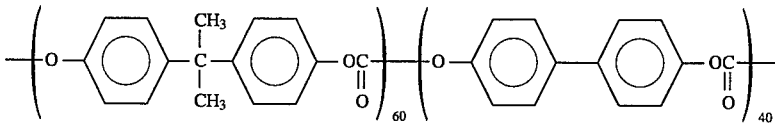

(E)

EXAMPLE 2

An electrophotographic photoreceptor was produced and tested in the same manner as in Example 1, except that a copolycarbonate resin represented by the following formula (A-2) (viscosity-average molecular weight, 42,900; manufactured by Mitsubishi Gas Chemical Company, Inc.) was used in place of the copolycarbonate resin represented by formula (A-1) used in Example 1 for forming a charge transport layer, and that toluene was used in place of monochlorobenzene. The results obtained are shown in Table 7.

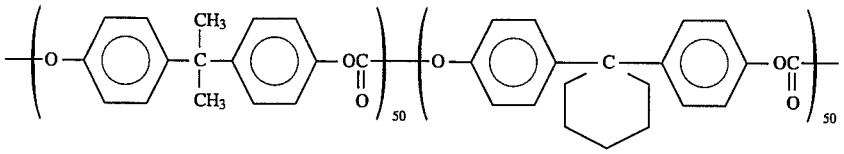

(A-2)

Comparative Example 4

An electrophotographic photoreceptor was produced in the same manner as in Example 2, except that the polycarbonate resin represented by formula (D) given above was used in place of the copolycarbonate resin represented by formula (A-2) used in Example 2 for forming a charge transport layer. This electrophotographic photoreceptor was tested in the same manner as in Example 1. The results obtained are shown in Table 7. The coating fluid gelled 3 days after the preparation thereof.

Comparative Example 5

An electrophotographic photoreceptor was produced in the same manner as in Example 2, except that 6 parts of the polycarbonate resin represented by formula (C) given above and 6 parts of the polycarbonate resin represented by formula (D) given above were used in place of the copolycarbonate resin represented by formula (A-2) used in Example 2 for forming a charge transport layer, and that tetrahydrofuran was used in place of toluene. This electrophotographic photoreceptor was tested in the same manner as in Example 1. The results obtained are shown in Table 7. The coating fluid gelled 6 days after the preparation thereof.

Comparative Example 6

An electrophotographic photoreceptor was produced and tested in the same manner as in Example 1, except that a copolycarbonate resin represented by the following structural formula (F) (viscosity-average molecular weight, 45,000; manufactured by Idemitsu Kosan Co., Ltd.) was used in place of the copolycarbonate resin represented by formula (A-1) used in Example 1 for forming a charge transport layer. The results obtained are shown in Table 7. The coating fluid gelled 5 days after the preparation thereof.

(F)

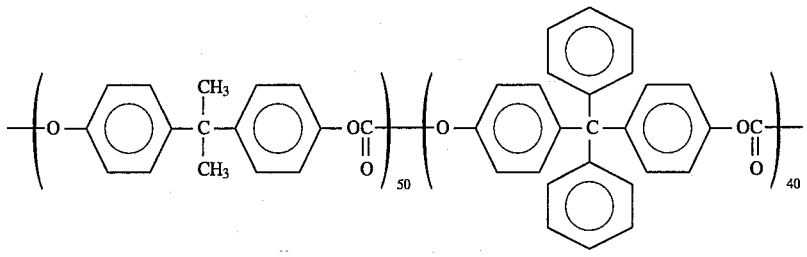

EXAMPLE 3

An electrophotographic photoreceptor was produced and tested in the same manner as in Example 1, except that a copolycarbonate resin represented by the following structural formula (A-3) (viscosity-average molecular weight, 43,800; manufactured by Mitsubishi Gas Chemical Company, Inc.) was used in place of the copolycarbonate resin represented by formula (A-1) used in Example 1 for forming a charge transport layer. The results obtained are shown in Table 7.

(A-3)

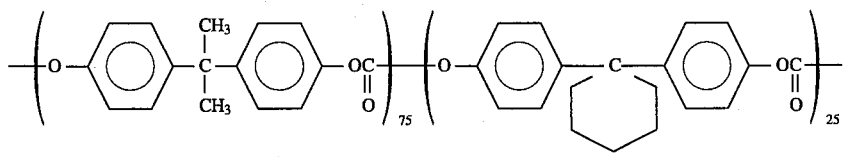

EXAMPLE 4

An electrophotographic photoreceptor was produced and tested in the same manner as in Example 1, except that a copolycarbonate resin represented by the following structural formula (B-1) (viscosity-average molecular weight, 43,000; manufactured by Mitsubishi Gas Chemical Company Inc.) was used in place of the copolycarbonate resin represented by formula (A-1) used in Example 1 for forming a charge transport layer. The results obtained are shown in Table 7.

(B-1)

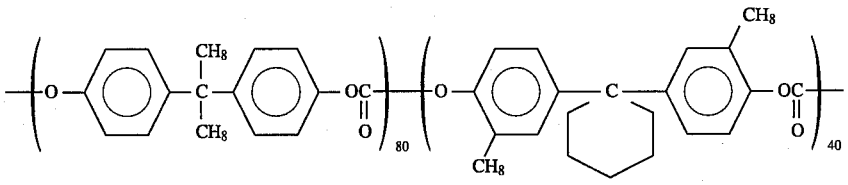

Comparative Example 7

An attempt was made to produce an electrophotographic photoreceptor in the same manner as in Example 1, except that a mixture of 6 parts by weight of the polycarbonate resin represented by structural formula (C) given above and 4 parts by weight of a copolycarbonate resin represented by the following structural formula (G) (viscosity-average molecular weight, 40,000; manufactured by Mitsubishi Gas Chemical Company, Inc.) was used in place of the copolycarbonate resin represented by formula (B-1) used in Example 4 for forming a charge transport layer. However, the polycarbonate resin represented by structural formula (C) did not dissolve in the solvent as in Comparative Examples 1 and 2 and failed to give a coating fluid. Because of this, an electrophotographic photoreceptor could not be produced.

(G)

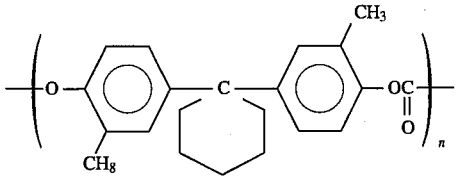

Comparative Example 8

An electrophotographic photoreceptor was produced and evaluated in the same manner as in Example 1, except that the butadiene derivative represented by the following structural formula (CTM-1) was used as a charge transport material in place of charge transport material III-28 used in Example 1 for forming a charge transport layer. The results obtained are shown in Table 7.

(CTM-1)

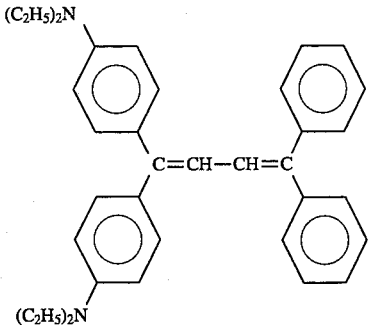

Comparative Example 9

An electrophotographic photoreceptor was produced and evaluated in the same manner as in Example 2, except that the hydrazone derivative represented by the following structural formula (CTM-2) was used as a charge transport material in place of charge transport material III-28 used in Example 2 for forming a charge transport layer. The results obtained are shown in Table 7.

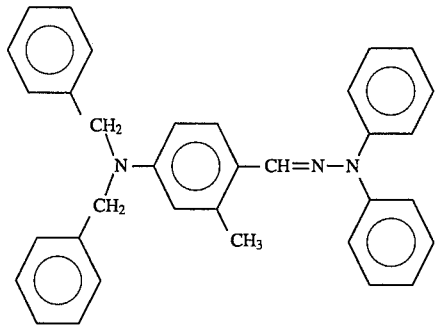

(CTM-2)

Comparative Example 10

An electrophotographic photoreceptor was produced and evaluated in the same manner as in Example 4, except that the hydrazone derivative represented by the following structural formula (CTM-3) was used as a charge transport material in place of charge transport material III-28 used in Example 4 for forming a charge transport layer. The results obtained are shown in Table 7.

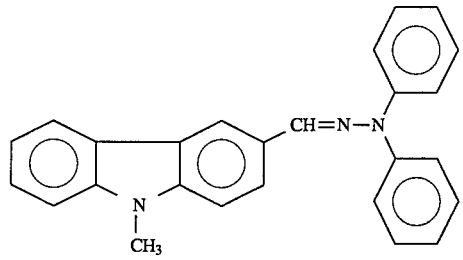

(CTM-3)

TABLE 7

| | Charge generating layer | | Charge transport layer | | 1st | | | 1000th | | | |
|---|---|---|---|---|---|---|---|---|---|---|---|
| | Charge generating material | Resin | Resin No. | Charge transport material No. | $V_o$ (V) | $E_{1/2}$ (erg/cm$^2$) | $V_{RP}$ (V) | $V_o$ (V) | $E_{1/2}$ (erg/cm$^2$) | $V_{RP}$ (V) | Coating fluid, film-forming property |
| Example 1 | titanyl phthalocyanine | poly(vinyl butyral) | A-1 | III-28 | −825 | 1.3 | −15 | −825 | 1.3 | −18 | no problem |
| Example 2 | titanyl phthalocyanine | poly(vinyl butyral) | A-2 | III-28 | −825 | 1.3 | −15 | −825 | 1.3 | −18 | " |
| Example 3 | titanyl phthalocyanine | poly(vinyl butyral) | A-3 | III-28 | −820 | 1.1 | −11 | −818 | 1.1 | −13 | " |
| Example 4 | titanyl phthalocyanine | poly(vinyl butyral) | B-1 | III-28 | −830 | 1.4 | −18 | −833 | 1.4 | −20 | " |
| Comparative Example 1 | titanyl phthalocyanine | poly(vinyl butyral) | C | III-28 | — | — | — | — | — | — | failed to give coating fluid |
| Comaparative (Example 2 | titanyl phthalocyanine | poly(vinyl butyral) | C/D mixture | III-28 | — | — | — | — | — | — | failed to give coating fluid |
| Comparative Example 3 | titanyl phthalocyanine | poly(vinyl butyral) | E | III-28 | −830 | 1.4 | −25 | −830 | 1.5 | −33 | coating fluid gelled in 25 days |
| Comparative Example 4 | titanyl phthalocyanine | poly(vinyl butyral) | D | III-28 | −825 | 1.3 | −18 | −825 | 1.3 | −20 | coating fluid gelled in 3 days |
| Comparative Example 5 | titanyl phthalocyanine | poly(vinyl butyral) | C/D mixture | III-28 | −820 | 1.4 | −17 | −820 | 1.4 | −20 | coating fluid gelled in 6 days |
| Comparative Example 6 | titanyl phthalocyanine | poly(vinyl butyral) | F | III-28 | −810 | 1.1 | −10 | −785 | 1.1 | −20 | coating fluid gelled in 5 days |
| Comparative Example 7 | titanyl phthalocyanine | poly(vinyl butyral) | C/G mixture | III-28 | — | — | — | — | — | — | failed to give coating fluid |
| Comparative Example 8 | titanyl phthalocyanine | poly(vinyl butyral) | A-1 | CTII-1 | −825 | 3.2 | −40 | −795 | 2.6 | −80 | no problem |
| Comparative Example 9 | titanyl phthalocyanine | poly(vinyl butyral) | A-2 | CTII-2 | −825 | 2.9 | −35 | −810 | 3.1 | −125 | " |
| Comparative Example 10 | titanyl phthalocyanine | poly(vinyl butyral) | B-1 | CTII-3 | −825 | 2.4 | −35 | −830 | 2.5 | −40 | " |

As described above, the copolycarbonate resins each comprising a repeating structural unit represented by formula (I) and a repeating structural unit represented by formula (II) not only dissolved in toluene or monochlorobenzene, which are a high-boiling solvent, but also showed good compatibility with the triarylamine compound and satisfactory film-forming properties. The copolycarbonate resins also showed stable electrical characteristics with high sensitivity. Moreover, those copolycarbonate resins gave coating fluids having satisfactory long-term stability, so that the producibility of electrophotographic photoreceptors was high. In contrast, the polycarbonate consisting of unit represented by formula (I), the polycarbonate consisting of unit represented by formula (II), and the mere mixture of both, which were used in some of the Comparative Examples, were insoluble in high-boiling solvents or difficult to dissolve therein. Even though such polycarbonates and mixture thereof were forcibly dissolved in a low-boiling solvent, the coating fluids showed poor long-term stability and gelled, resulting in poor producibility. The copolycarbonate resins used in Comparative Examples 3 and 6, which each consisted of the unit represented by formula (I) and a homopolymer not represented by formula (II), gave coating fluids having poor long-term stability, resulting in poor producibility. The above indicates that copolycarbonate resins each comprising a repeating structural unit represented by formula (I) and a repeating structural unit represented by formula (II) are desirable. On the other hand, the charge transport materials used in Comparative Examples 8 to 10, which were not the triarylamine type, gave stable coating fluids, but the electrophotographic photoreceptors obtained therefrom were defective in electrical characteristics, that is, these photoreceptors had a reduced sensitivity and clearly lower stability in repeated use than electrophotographic photoreceptors employing a triarylamine type charge transport material. The above indicates that the charge transport material used in combination with the copolycarbonate resin comprising a repeating structural unit represented by formula (I) and a repeating structural unit represented by formula (II) is desirably a triarylamine compound.

EXAMPLE 5

An electrophotographic photoreceptor employing an aluminum drum substrate was produced in the same manner as in Example 1, except that X-form metal-free phthalocyanine was used in place of the titanyl phthalocyanine used in Example 1 as a charge generating material for forming a charge generating layer. The electrophotographic photoreceptor obtained was mounted in a laser beam printer (obtained by modifying FX4105 Laser Press, manufactured by Fuji Xerox Co., Ltd.), with the cleaning blade being pushed against the photoreceptor at a force three times the ordinary one. This printer was operated without paper feeding, i.e., without transfer to paper, for a period corresponding to 20,000-sheet printing. Thereafter, the photoreceptor was evaluated for image quality and examined for wear loss. The results obtained are shown in Table 8.

EXAMPLES 6 TO 8

Photoreceptors were produced and tested in the same manner as in Example 5, except that each of copolycarbonate resins represented by structural formula (A-1) given above and respectively having viscosity-average molecular weights of 20,100, 32,000, and 57,100 was used in place of the copolycarbonate resin used in Example 5, which was represented by structural formula (A-1) and had a viscosity-average molecular weight of 45,400. The results obtained are shown in Table 8.

EXAMPLES 9 TO 12

Photoreceptors were produced and tested in the same manner as in Example 5, except that each of copolycarbonate resins represented by structural formula (B-1) given above and respectively having viscosity-average molecular weights of 21,100, 31,000, 40,000, and 53,000 was used in place of the copolycarbonate resin represented by structural formula (A-1) used in Example 5, and that triarylamine compound III-7 specified hereinabove was used in place of triarylamine compound III-28 specified hereinabove. The results obtained are shown in Table 8.

Comparative Example 11

A photoreceptor was produced and tested in the same manner as in Example 6, except that benzidine compound IV-27 specified hereinabove was used in place of the triarylamine compound III-28 used in Example 6 as a charge transport material for forming a charge transport layer. The results obtained are shown in Table 8.

Comparative Example 12

A photoreceptor was produced and tested in the same manner as in Example 6, except that benzidine compound IV-28 specified hereinabove was used in place of the triarylamine compound III-7 used in Example 9 as a charge transport material for forming a charge transport layer. The results obtained are shown in Table 8.

TABLE 8

| | Charge generating layer | | Charge transport layer | | | | |
|---|---|---|---|---|---|---|---|
| | | | Resin | | | | |
| | Charge generating material | Resin | No. | Viscosity-average molecular weight | Charge transport material No. | Wear loss (μm) | Image quality after 20,000-sheet printing |
| Example 5 | X-form metal-free phthalocyanine | poly(vinyl butyral) | A-1 | 45,400 | III/28 | 4.0 | no image defect |
| Example 6 | X-form metal-free phthalocyanine | poly(vinyl butyral) | A-1 | 20,100 | III-28 | 7.2 | fogging occurred in a very small part |
| Example 7 | X-form metal-free phthalocyanine | poly(vinyl butyral) | A-1 | 32,000 | III-28 | 4.8 | no image defect |
| Example 8 | X-form metal-free phthalocyanine | poly(vinyl butyral) | A-1 | 57,100 | III-28 | 3.6 | " |
| Example 9 | X-form metal-free phthalocyanine | poly(vinyl butyral) | B-1 | 21,100 | III-7 | 7.0 | " |
| Example 10 | X-form metal-free phthalocyanine | poly(vinyl butyral) | B-1 | 31,000 | III-7 | 4.4 | " |
| Example 11 | X-form metal-free phthalocyanine | poly(vinyl butyral) | B-1 | 40,000 | III-7 | 3.5 | " |
| Example 12 | X-form metal-free phthalocyanine | poly(vinyl butyral) | B-1 | 53,000 | III-7 | 3.3 | " |
| Comparative | X-form metal-free | poly(vinyl | A-1 | 20,100 | IV-27 | 9.4 | fogging occurred |

TABLE 8-continued

| | Charge generating layer | | Charge transport layer | | | | |
|---|---|---|---|---|---|---|---|
| | | | Resin | | | | |
| | Charge generating material | Resin | No. | Viscosity-average molecular weight | Charge transport material No. | Wear loss (μm) | Image quality after 20,000-sheet printing |
| Example 11 | phthalocyanine | butyral) | | | | | entirely |
| Comparative Example 12 | X-form metal-free phthalocyanine | poly(vinyl butyral) | B-1 | 21,100 | IV-28 | 9.3 | fogging occurred entirely |

Table 8 shows that the electrophotographic photoreceptors of Examples 5 to 12 attained stable image quality over long and caused no problem, but the electrophotographic photoreceptor employing a copolycarbonate resin having a viscosity-average molecular weight of 20,100 came to cause image defects in a very small part as the wear loss increased. It was also found that an electrophotographic photoreceptor employing a copolycarbonate resin having a viscosity-average molecular weight lower than 20,000 shows an even larger wear loss and has even poorer performance with respect to the retention of image quality. Consequently, the viscosity-average molecular weight of the copolycarbonate resin is preferably 20,000 or higher.

The electrophotographic photoreceptors of Comparative Examples 11 and 12, in which the charge transport layer employed a benzidine compound alone as a charge transport material, showed a larger wear loss of the charge transport layer than the electrophotographic photoreceptors of the Examples, which employed a triarylamine compound. As a result, the photoreceptors of Comparative Examples 11 and 12 caused image defects. It was found that these problems cannot be eliminated with a copolycarbonate resin having a viscosity-average molecular weight of 20,000.

EXAMPLE 13

A solution consisting of 20 parts of a zirconium compound (Orgatics ZC540, manufactured by Matsumoto Seiyaku K.K.), 2 parts of a silane compound (A1110, manufactured by Nippon Unicar Co., Ltd.), 1.5 parts of a poly(vinyl butyral) resin (S-Lec BM-S, manufactured by Sekisui Chemical Co., Ltd.), and 70 parts of butanol was applied to an aluminum substrate by dip coating. The coating was dried by heating at 150° C. for 10 minutes to form an undercoat layer having a thickness of 0.9 μm.

Figure 9:
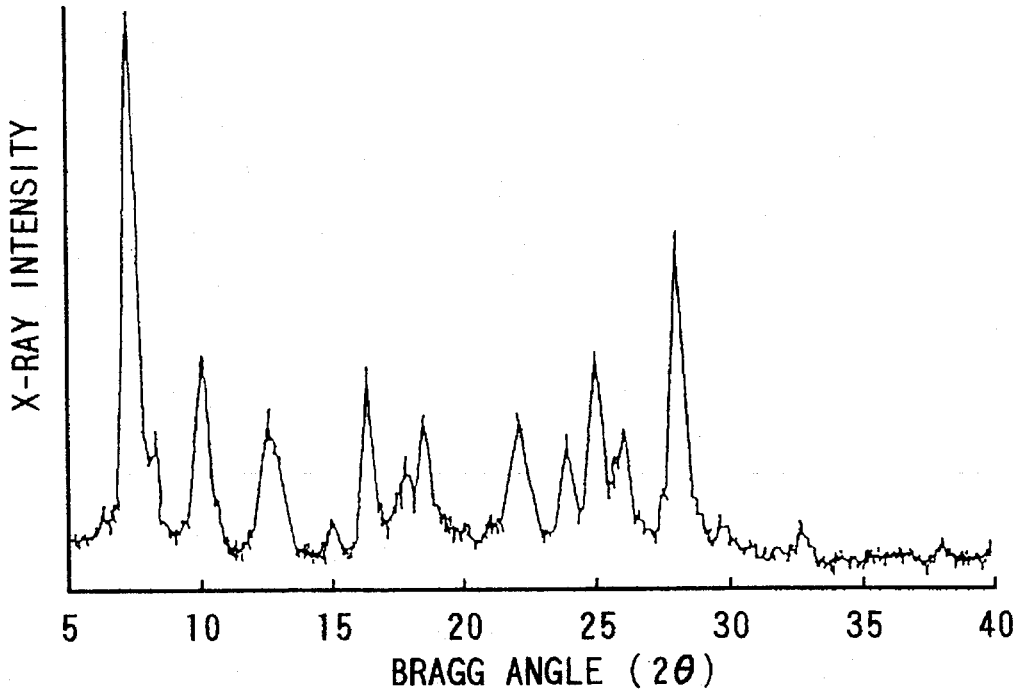
FIG. 9 is an X-ray diffraction spectrum (obtained with $CuK_\alpha$) of the hydroxygallium phthalocyanine powder used in Examples 13–20, 25, 26, 32, 33, 36, 38, 39, and 42–44.

A mixture of 1 part of hydroxygallium phthalocyanine having the X-ray diffraction spectrum shown in FIG. 9 as a charge generating material, 1 part of a carboxylated vinyl chloride-vinyl acetate copolymer (VMCH, manufactured by Union Carbide Corp.), and 100 parts of chlorobenzene was subjected to a dispersion treatment with a sand mill for 1 hour together with glass beads. The coating fluid obtained was applied to the undercoat layer by dip coating and dried by heating at 100° C. for 10 minutes to form a charge generating layer having a thickness of 0.25 μm.

Subsequently, a coating fluid obtained by dissolving 12 parts of a copolycarbonate resin represented by formula (A-1) given above (viscosity-average molecular weight, 45,400; manufactured by Mitsubishi Gas Chemical Company, Inc.) and 8 parts of triarylamine compound III-28 specified hereinabove as a charge transport material into 100 parts of monochlorobenzene was applied to the charge generating layer. The coating was dried by heating at 115° C. for 60 minutes to form a charge transport layer having a thickness of about 20 μm. The electrophotographic photoreceptor thus obtained was evaluated in the same manner as in Example 1. The results obtained are shown in Table 9.

EXAMPLE 14

A photoreceptor was produced and tested in the same manner as in Example 13, except that triarylamine compound III-50 specified hereinabove was used in place of the triarylamine compound III-28 used in Example 13 as a charge transport material for forming a charge transport layer. The results obtained are shown in Table 9.

EXAMPLE 15

A photoreceptor was produced and tested in the same manner as in Example 13, except that triarylamine compound III-7 specified hereinabove was used in place of the triarylamine compound III-28 used in Example 13 as a charge transport material for forming a charge transport layer. The results obtained are shown in Table 9.

EXAMPLE 16

A photoreceptor was produced and tested in the same manner as in Example 13, except that a copolycarbonate resin represented by the following structural formula A-4 (viscosity-average molecular weight, 40,700; manufactured by Mitsubishi Gas Chemical Company, Inc.) was used in place of the copolycarbonate resin represented by structural formula A-1 used in Example 13 for forming a charge transport layer, and that a combination of 4 parts of triarylamine compound III-40 specified hereinabove and 4 parts of triarylamine compound III-64 specified hereinabove was used as a charge transport material in place of triarylamine compound III-28 specified hereinabove. The results obtained are shown in Table 9.

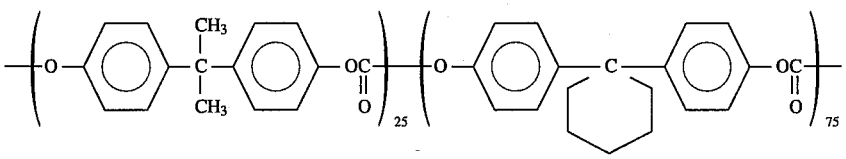

(A-4)

EXAMPLE 17

A photoreceptor was produced and tested in the same manner as in Example 13, except that the copolycarbonate resin represented by structural formula B-1 given above was used in place of the copolycarbonate resin represented by structural formula A-1 used in Example 13 for forming a charge transport layer. The results obtained are shown in Table 9.

EXAMPLE 18

A photoreceptor was produced and tested in the same manner as in Example 13, except that a copolycarbonate resin represented by the following structural formula B-2 (viscosity-average molecular weight, 41,500) was used in place of the copolycarbonate resin represented by structural formula B-1 used in Example 17 for forming a charge transport layer, and that 4 parts of triarylamine compound III-40 specified hereinabove was used as a charge transport material in place of triarylamine compound III-28 specified hereinabove. The results obtained are shown in Table 9.

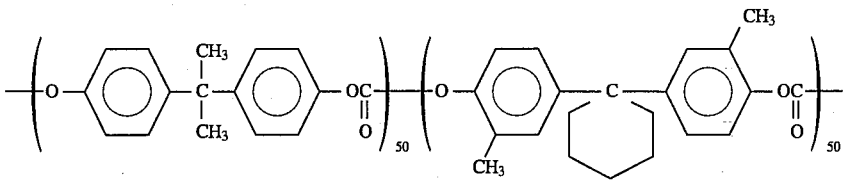

(B-2)

EXAMPLE 19

A photoreceptor was produced and tested in the same manner as in Example 13, except that a copolycarbonate resin represented by the following structural formula B-3 (viscosity-average molecular weight, 39,500) was used in place of the copolycarbonate resin represented by structural formula B-1 used in Example 17 for forming a charge transport layer, and that a combination of 6 parts of triarylamine compound III-7 specified hereinabove and 2 parts of benzidine compound IV-27 specified hereinabove was used as a charge transport material in place of triarylamine compound III-28 specified hereinabove. The results obtained are shown in Table 9.

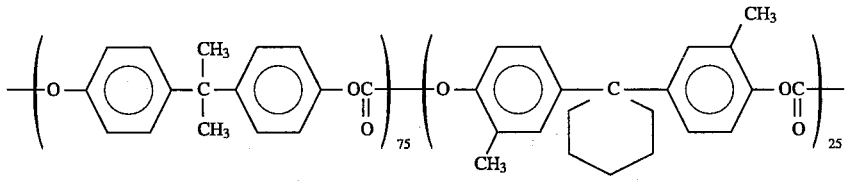

(B-3)

EXAMPLE 20

A photoreceptor was produced and tested in the same manner as in Example 13, except that a copolycarbonate resin represented by the following structural formula B-4 (viscosity-average molecular weight, 43,000) was used in place of the copolycarbonate resin represented by structural formula B-1 used in Example 17 for forming a charge transport layer, and that a combination of 6 parts of triarylamine compound III-28 specified hereinabove and 2 parts of benzidine compound IV-28 specified hereinabove was used as a charge transport material. The results obtained are shown in Table 9.

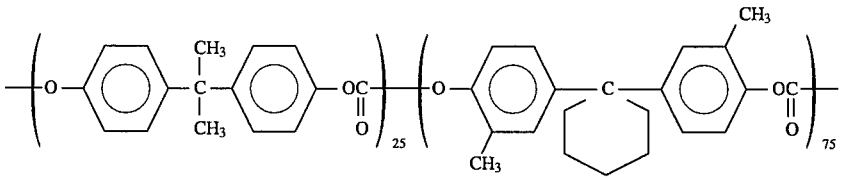

(B-4)

TABLE 9

| | Charge generating layer | | Charge transport layer | | 1st | | | 1000th | | |
|---|---|---|---|---|---|---|---|---|---|---|
| | Charge generating material | Resin | Resin No. | Charge transport material No. | $V_o$ (V) | $E_{1/2}$ (erg/cm$^2$) | $V_{RP}$ (V) | $V_o$ (V) | $E_{1/2}$ (erg/cm$^2$) | $V_{RP}$ (V) |
| Example 13 | hydroxygallium phthalocyanine | modified vinyl chloride vinyl acetate copolymer | A-1 | III-28 | −820 | 1.6 | −15 | −820 | 1.6 | −16 |
| Example 14 | hydroxygallium phthalocyanine | modified vinyl chloride vinyl acetate copolymer | A-1 | III-50 | −810 | 1.3 | −5 | −800 | 1.3 | −5 |
| Example 15 | hydroxygallium phthalocyanine | modified vinyl chloride vinyl acetate copolymer | A-1 | III-7 | −825 | 1.7 | −20 | −825 | 1.7 | −25 |
| Example 16 | hydroxygallium phthalocyanine | modified vinyl chloride vinyl acetate copolymer | A-4 | III-40/III-64 1/1 | −820 | 1.6 | −18 | −830 | 1.6 | −25 |
| Example 17 | hydroxygallium phthalocyanine | modified vinyl chloride vinyl acetate copolymer | B-1 | III-28 | −825 | 1.7 | −20 | −827 | 1.7 | −25 |
| Example 18 | hydroxygallium phthalocyanine | modified vinyl chloride vinyl acetate copolymer | B-2 | III-40 | −825 | 1.8 | −23 | −828 | 1.8 | −30 |
| Example 19 | hydroxygallium phthalocyanine | modified vinyl chloride vinyl acetate copolymer | B-3 | III-7/IV-27 3/1 | −830 | 2.0 | −35 | −830 | 2.1 | −40 |
| Example 20 | hydroxygallium phthalocyanine | modified vinyl chloride vinyl acetate copolymer | B-4 | III-28/IV-28 3/1 | −825 | 1.9 | −33 | −825 | 1.9 | −37 |

All the coating fluids and coating films had no problem.

EXAMPLE 21

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol, and 20 parts of butanol was applied to an aluminum substrate by dip coating. The coating was dried by heating at 150° C. for 10 minutes to form an undercoat layer having a thickness of 0.1 μm.

A mixture of 1 part of gallium phthalocyanine having the X-ray diffraction spectrum shown in FIG. 7 as a charge generating material, 1 part of a poly(vinyl butyral) resin (S-Lec BM-1, manufactured by Sekisui Chemical Co., Ltd.), and 100 parts of cyclohexanone was subjected to a dispersion treatment with a sand mill for 1 hour together with glass beads. The coating fluid obtained was applied to the undercoat layer by dip coating and dried by heating at 100° C. for 10 minutes to form a charge generating layer having a thickness of 0.2 μm.

Subsequently, a coating fluid obtained by dissolving 12 parts of a copolycarbonate resin represented by formula (A-1) given above (viscosity-average molecular weight, 45,400; manufactured by Mitsubishi Gas Chemical Company, Inc.) and 8 parts of triarylamine compound III-28 specified hereinabove as a charge transport material into 100 parts of monochlorobenzene was applied to the charge generating layer. The coating was dried by heating at 120° C. for 60 minutes to form a charge transport layer having a thickness of about 20 μm. The electrophotographic photoreceptor thus obtained was evaluated in the same manner as in Example 1. The results obtained are shown in Table 10.

EXAMPLE 22

A photoreceptor was produced and tested in the same manner as in Example 1, except that a carboxylated vinyl chloride-vinyl acetate copolymer (VMCH, manufactured by Union Carbide Corp.) was used in place of the poly(vinyl butyral) resin used in Example 21 as a binder resin for forming a charge generating layer, and that the copolycarbonate represented by formula (A-3) given above was used in place of the copolycarbonate represented by formula (A-1) used for forming a charge transport layer. The results obtained are shown in Table 10.

EXAMPLE 23

A photoreceptor was produced and tested in the same manner as in Example 21, except that in place of the gallium phthalocyanine used in Example 21 as a charge generating material for forming a charge generating layer, 1 part of chlorogallium phthalocyanine having the X-ray diffraction spectrum shown in FIG. 8 was used as a mixture with 1 part of a poly(vinyl butyral) resin (S-Lec BM-S, manufactured by Sekisui Chemical Co., Ltd.), 65 parts of xylene, and 35 parts of n-butyl acetate. The results obtained are shown in Table 10.

EXAMPLE 24

A photoreceptor was produced and tested in the same manner as in Example 1, except that a carboxylated vinyl chloride-vinyl acetate copolymer (VMCH, manufactured by Union Carbide Corp.) was used in place of the poly(vinyl butyral) resin used in Example 23 as a binder resin for forming a charge generating layer, and that the copolycarbonate represented by formula (B-1) given above was used in place of the copolycarbonate represented by formula (A-1) used for forming a charge transport layer. The results obtained are shown in Table 10.

EXAMPLE 25

A photoreceptor was produced and tested in the same manner as in Example 1, except that the hydroxygallium phthalocyanine having the X-ray diffraction spectrum shown in FIG. 9 was used in place of the charge generating material used in Example 23 for forming a charge generating layer, and that a combination of 6 parts of triarylamine compound III-28 specified hereinabove and 2 parts of benzidine compound IV-27 specified hereinabove was used as a charge transport material for forming a charge transport layer. The results obtained are shown in Table 10.

EXAMPLE 26

A photoreceptor was produced and tested in the same manner as in Example 1, except that a combination of 4 parts of triarylamine compound III-28 specified hereinabove and 4 parts of triarylamine compound III-7 specified hereinabove was used in place of the charge transport material used in Example 25 for forming a charge transport layer, and that the copolycarbonate represented by formula (B-1) given above was used in place of the copolycarbonate represented by formula (A-1) given above. The results obtained are shown in Table 10.

EXAMPLE 27

A photoreceptor was produced and tested in the same manner as in Example 1, except that X-form metal-free phthalocyanine was used in place of the gallium phthalocyanine used in Example 22 for forming a charge transport layer, and that a combination of 6 parts of triarylamine compound III-7 specified hereinabove and 2 parts of triarylamine compound III-50 specified hereinabove was used as a charge transport material for forming a charge transport layer. The results obtained are shown in Table 10.

TABLE 10

| | Charge generating layer | | Charge transport layer | | 1st | | | 1000th | | |
|---|---|---|---|---|---|---|---|---|---|---|
| | Charge generating material | Resin | Resin No. | Charge transport material No. | $V_o$ (V) | $E_{1/2}$ (erg/cm$^2$) | $V_{RP}$ (V) | $V_o$ (V) | $E_{1/2}$ (erg/cm$^2$) | $V_{RP}$ (V) |
| Example 21 | gallium phthalocyanine | poly(vinyl butyral) | A-1 | III-28 | −825 | 2.8 | −25 | −820 | 2.8 | −30 |
| Example 22 | gallium phthalocyanine | modified vinyl chloride-vinyl acetate | A-3 | III-28 | −823 | 2.0 | −16 | −820 | 2.0 | −15 |
| Example 23 | chlorogallium phthalocyanine | poly(vinyl butyral) | A-1 | III-28 | −825 | 2.5 | −23 | −820 | 2.4 | −26 |
| Example 24 | chlorogallium phthalocyanine | modified vinyl chloride vinyl acetate | B-1 | III-28 | −810 | 1.9 | −18 | −805 | 1.8 | −20 |
| Example 25 | hydroxygallium phthalocyanine | poly(vinyl butyral) | A-1 | III-28/IV-27 3/1 | −815 | 2.1 | −20 | −815 | 2.1 | −22 |
| Example 26 | hydroxygallium phthalocyanine | poly(vinyl butyral) | B-1 | III-7/III-28 1/1 | −823 | 2.5 | −30 | −820 | 2.4 | −82 |
| Example 27 | X-form metal-free phthalocyanine | modified vinyl chloride-vinyl acetate | A-3 | III-7/III-50 3/1 | −825 | 5.2 | −37 | −828 | 5.2 | −40 |

EXAMPLE 28

For the purpose of examining photoreceptors for corona discharge resistance, a modified laser printer in which the photoreceptor was capable of rotating without a toner while undergoing only the steps of corona charging with a scorotron, exposure, and discharge was produced from a laser beam printer (FX4105 Laser Press, manufactured by Fuji Xerox Co., Ltd.) by removing the developer, cleaning blade, and evacuation fan therefrom. An electrophotographic photoreceptor employing an aluminum drum substrate and produced in the same manner as in Example 1 was mounted in a laser beam printer (FX4105 Laser Press, manufactured by Fuji Xerox Co., Ltd.), and this printer was regulated to give the optimal exposure to ascertain that prints of good image quality were obtained. This electrophotographic photoreceptor was transferred to the modified printer, which was then operated under conditions of 20° C. and 55% RH for 60 minutes. Immediately thereafter, the photoreceptor was remounted in the regulated laser beam printer, and this printer was operated in the same atmosphere to examine the effect of the corona discharge resistance of the photoreceptor on image quality. The results obtained are shown in Table 11.

EXAMPLES 29 TO 37

Drum-form electrophotographic photoreceptors respectively having the constitutions of Examples 4, 6, 9, 16, 19, 22, 23, 25, and 27 were produced, and evaluated in the same manner as in Example 28. The results obtained are shown in Table 11.

Comparative Examples 13 and 14

Drum-form electrophotographic photoreceptors respectively having the constitutions of Comparative Examples 11 and 12 were produced, and evaluated in the same manner as in Example 28. The results obtained are shown in Table 11.

TABLE 11

| | Photo-receptor constitution | Charge generating layer: Charge generating material | Charge generating layer: Resin | Charge transport layer: Resin No. | Charge transport layer: Charge transport material No. | Initial image quality | Image quality after corona discharge test |
|---|---|---|---|---|---|---|---|
| Example 28 | Example 1 | titanyl phthalocyanine | poly(vinyl butyral) | A-1 | III-28 | no problem | no problem |
| Example 29 | Example 4 | titanyl phthalocyanine | poly(vinyl butyral) | B-1 | III-28 | " | " |
| Example 30 | Example 6 | X-form metal-free phthalocyanine | poly(vinyl butyral) | A-1 | III-28 | " | " |
| Example 31 | Example 9 | X-form metal-free phthalocyanine | poly(vinyl butyral) | B-1 | III-7 | " | " |
| Example 32 | Example 16 | hydroxygallium phthalocyanine | modified vinyl chloride-vinyl acetate | A-4 | III-40/III-64 1/1 | " | " |
| Example 33 | Example 19 | hydroxygallium phthalocyanine | modified vinyl chloride-vinyl acetate | B-3 | III-7/IV-27 3/1 | " | " |
| Example 34 | Example 22 | gallium phthalocyanine | modified vinyl chloride-vinyl acetate | A-3 | III-28 | " | " |
| Example 35 | Example 23 | chlorogallium phthalocyanine | poly(vinyl butyral) | A-1 | III-28 | " | " |
| Example 36 | Example 25 | hydroxygallium phthalocyanine | poly(vinyl butyral) | A-1 | III-28/IV-27 3/1 | " | " |
| Example 37 | Example 27 | X-form metal-free phthalocyanine | modified vinyl chloride-vinyl acetate | A-3 | III-7/III-50 3/1 | " | " |
| Comparative Example 13 | Comparative Example 11 | X-form metal-free phthalocyanine | modified vinyl chloride-vinyl acetate | A-1 | IV-27 | " | partial image streaking in 15 min. partial image streaking in 30 min. |
| Comparative Example 14 | Comparative Example 12 | X-form metal-free phthalocyanine | modified vinyl chloride-vinyl acetate | B-1 | IV-28 | " | entire image streaking in 15 min. |

EXAMPLE 38

A solution consisting of 1 part of an alcohol-soluble nylon resin (Lacamide L-5003, manufactured by Dainippon Ink & Chemicals, Inc., Japan), 8 parts of methanol, and 2 parts of butanol was applied to an aluminum drum substrate by dip coating. The coating was dried by heating at 120° C. for 10 minutes to form an undercoat layer having a thickness of 0.6 μm.

To a mixed solvent consisting of 70 parts of monochlorobenzene and 30 parts of methylene chloride were dissolved 10 parts of triarylamine compound III-28 specified hereinabove as a charge transport material and 12 parts of the copolycarbonate resin represented by structural formula (A-1) given above and 1 part of a polyester resin (Vylon 200, manufactured by Toyobo Co., Ltd., Japan) as binder resins. To this solution was added 1 part of the hydroxy phthalocyanine having the X-ray diffraction spectrum shown in FIG. 9 as a charge generating material. This mixture was treated with a sand mill for 1 hour together with glass beads to disperse the phthalocyanine. The coating fluid obtained was applied to the undercoat layer by dip coating and dried by heating at 125° C. for 60 minutes to obtain a single-layer photoreceptor having a film thickness of 27 μm.

The electrophotographic photoreceptor drum thus obtained was mounted in a modified laser printer obtained from laser beam printer XP-15 (manufactured by Fuji Xerox Co., Ltd.). This printer was operated in a 20° C. 45% RH atmosphere without paper feeding, i.e., without transfer to paper, for a period corresponding to 30,000-sheet printing. Thus, the wear loss caused by the copying operation was measured, and image quality was evaluated. The results obtained are shown in Table 12.

EXAMPLE 39

A photoreceptor was produced and tested in the same manner as in Example 38, except that a combination of 6 parts of triarylamine compound III-28 specified hereinabove and 3 parts of triarylamine compound III-50 specified hereinabove was used in place of the charge transport material used in Example 38. The results obtained are shown in Table 12.

EXAMPLE 40

A photoreceptor was produced and tested in the same manner as in Example 38, except that the chlorogallium phthalocyanine having the X-ray diffraction spectrum shown in FIG. 8 was used in place of the hydroxy phthalocyanine used in Example 38 as a charge generating material, and that 12 parts of the copolycarbonate resin represented by structural formula (B-1) given above and a modified vinyl chloride-vinyl acetate copolymer (VMCH, manufactured by Union Carbide Corp.) were used as binder resins in place of the copolycarbonate resin represented by structural formula (A-1) given above and the polyester resin, respectively. The results obtained are shown in Table 12.

EXAMPLE 41

A photoreceptor was produced in the same manner as in Example 40, except that X-form metal-free phthalocyanine was used in place of the chlorogallium phthalocyanine used in Example 40 as a charge generating material for forming a charge generating layer, and that a combination of 6 parts of triarylamine compound III-28 specified hereinabove and 3 parts of benzidine compound IV-27 specified hereinabove was used. The thus-obtained photoreceptor was tested in the same manner as in Example 38. The results obtained are shown in Table 12.

EXAMPLE 42

A photoreceptor was produced and tested in the same manner as in Example 38, except that 12 parts of triarylamine compound III-7 specified hereinabove was used in place of the triarylamine compound III-28 used in Example 38 as a charge transport material, and that a combination of 0.7 parts of the hydroxygallium phthalocyanine having the X-ray diffraction spectrum shown in FIG. 9 and 0.3 parts of the chlorogallium phthalocyanine having the X-ray diffraction spectrum shown in FIG. 8 was used as a charge generating material. The results obtained are shown in Table 12.

EXAMPLE 43

A photoreceptor was produced and tested in the same manner as in Example 38, except that 11 parts of triarylamine compound III-40 specified hereinabove was used in place of the triarylamine compound III-28 used in Example 38 as a charge transport material, and that a combination of 0.7 parts of the hydroxygallium phthalocyanine having the X-ray diffraction spectrum shown in FIG. 9 and 0.3 parts of titanyl phthalocyanine was used as a charge generating material. The results obtained are shown in Table 12.

EXAMPLE 44

A photoreceptor was produced and tested in the same manner as in Example 38, except that 6 parts of the copolycarbonate resin represented by structural formula (A-3) given above and 6 parts of the copolycarbonate resin represented by structural formula (B-4) given above were used as binder resins in place of the copolycarbonate resin represented by structural formula (A-1) used in Example 38, and that a modified vinyl chloride-vinyl acetate copolymer (VMCH, manufactured by Union Carbide Corp.) was used as another binder resin in place of the polyester resin. The results obtained are shown in Table 12.

and 20 parts of butanol was applied to an aluminum substrate by dip coating. The coating was dried by heating at 150° C. for 10 minutes to form an undercoat layer having a thickness of 0.1 μm.

A mixture of 90 parts of trigonal selenium (manufactured by Xerox Corp.) as a charge generating material, 10 parts of a poly(vinyl butyral) resin (S-Lec BM-S, manufactured by Sekisui Chemical Co., Ltd.), and 300 parts of n-butyl alcohol was agitated to disperse the charge generating material. The dispersion obtained was diluted by adding n-butyl alcohol thereto in an amount of 2 parts per part of the dispersion. The diluted dispersion was applied to the undercoat layer and dried by heating at 120° C. for 10 minutes to form a charge generating layer having a thickness of 0.2 μm.

Subsequently, a coating fluid obtained by dissolving 12 parts of the copolycarbonate represented by formula (A-1) used in Example 1 and 8 parts of triarylamine compound III-28 specified hereinabove as a charge transport material into 100 parts of monochlorobenzene was applied to the charge generating layer. The coating was dried by heating at 115° C. for 60 minutes to form a charge transport layer having a thickness of about 20 μm.

The electrophotographic photoreceptor thus produced was examined for electrophotographic characteristics as follows.

Using an electrostatic copying paper tester (Electrostatic Analyzer EPA-8100, manufactured by Kawaguchi Denki Seisakusho K.K.), the electrophotographic photoreceptor was charged by means of −6 kV corona discharge in an ordinary-temperature ordinary-humidity atmosphere (20° C., 40% RH). The charged photoreceptor was exposed to white light at an illuminance of 5 lx to determine the initial surface potential $V_O$ (volt), half decay exposure $E_{1/2}$ (lx·sec), and residual potential $V_{RP}$ (volt). The charging and exposure described above were repeated 1,000 times, and the $V_O$, $E_{1/2}$, and $V_{RP}$ were then determined. The results obtained are shown in Table 13.

TABLE 12

| | Photosensitive layer | | Charge transport | Wear loss | Image quality after 30,000- |
|---|---|---|---|---|---|
| | Charge generating material | Binder resin | material No. | (μm) | sheet printing |
| Example 38 | hydroxygallium phthalocyanine | (A-1) + polyester | III-28 | 2.4 | no problem |
| Example 39 | " | " | III-28/III-50 2/1 | 2.2 | " |
| Example 40 | chlorogallium phthalocyanine | (B-1) + modified vinyl chloride-vinyl acetate | III-28 | 2.2 | " |
| Example 41 | X-form metal-free phthalocyanine | (B-1) + modified vinyl chloride-vinyl acetate | III-28/IV-27 6/3 | 2.7 | " |
| Example 42 | hydroxygallium phthalocyanine, chlorogallium phthalocyanine | (A-1) + polyester | III-7 | 3.1 | " |
| Example 43 | hydroxygallium phthalocyanine, titanyl phthalocyanine | " | III-40 | 2.6 | " |
| Example 44 | hydroxygallium phthalocyanine | (A-3)/(B-4) = 1/1 + modified vinyl chloride-vinyl acetate | III-28 | 2.1 | " |

All the coating fluids and coating films had no problem.

EXAMPLE 45

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol,

EXAMPLE 46

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol, and 20 parts of butanol was applied to an aluminum substrate by dip coating. The coating was dried by heating at 150° C. for 10 minutes to form an undercoat layer having a thickness of 0.1 μm.

A mixture of 60 parts of dibromoanthanthrone (Monolite Red 2Y, manufactured by ICI) as a charge generating material, 40 parts of a poly(vinyl butyral) resin (S-Lec BM-1, manufactured by Sekisui Chemical Co., Ltd.), and 200 parts of cyclohexanone was subjected to a dispersion treatment for 3 hours with a sand mill employing glass beads having a diameter of 1 mm as a dispersing medium. The dispersion thus prepared was applied to the undercoat layer and dried by heating at 100° C. for 10 minutes to form a charge generating layer having a thickness of 0.1 μm.

Subsequently, a coating fluid obtained by dissolving 12 parts of the copolycarbonate represented by formula (A-1) used in Example 1 and 8 parts of triarylamine compound III-28 specified hereinabove as a charge transport material into 100 parts of monochlorobenzene was applied to the charge generating layer. The coating was dried by heating at 115° C. for 60 minutes to form a charge transport layer having a thickness of about 20 μm. The electrophotographic photoreceptor thus produced was examined for electrophotographic characteristics in the same manner as in Example 45. The results obtained are shown in Table 13.

EXAMPLE 47

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol, and 20 parts of butanol was applied to an aluminum substrate by dip coating. The coating was dried by heating at 150° C. for 10 minutes to form an undercoat layer having a thickness of 0.1 μm.

As a charge generating material was used bisbenzimidazolylperylene (a mixture of cis and trans isomers) which had been synthesized by the method described in JP-A-3-24059, purified by sublimation, and reduced to a pigment size through pulverization with a ball mill. A mixture of 60 parts of this charge generating material, 40 parts of a poly(vinyl butyral) resin (S-Lec BM-1, manufactured by Sekisui Chemical Co., Ltd.), and 200 parts of cyclohexanone was subjected to a dispersion treatment for 6 hours with a sand mill employing glass beads having a diameter of 1 mm as a dispersing medium. The dispersion thus prepared was applied to the undercoat layer and dried by heating at 100° C. for 10 minutes to form a charge generating layer having a thickness of 0.1 μm.

Subsequently, a coating fluid obtained by dissolving 12 parts of the copolycarbonate represented by formula (A-1) used in Example 1 and 8 parts of triarylamine compound III-28 specified hereinabove as a charge transport material into 100 parts of monochlorobenzene was applied to the charge generating layer. The coating was dried by heating at 115° C. for 60 minutes to form a charge transport layer having a thickness of about 20 μm. The electrophotographic photoreceptor thus produced was examined for electrophotographic characteristics in the same manner as in Example 45. The results obtained are shown in Table 13.

EXAMPLE 48

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol, and 20 parts of butanol was applied to an aluminum substrate by dip coating. The coating was dried by heating at 150° C. for 10 minutes to form an undercoat layer having a thickness of 0.1 μm.

A mixture of 90 parts of trigonal selenium (manufactured by Xerox Corp.) as a charge generating material, 10 parts of a poly(vinyl butyral) resin (S-Lec BM-S, manufactured by Sekisui Chemical Co., Ltd.), and 300 parts of n-butyl alcohol was agitated to disperse the charge generating material. The dispersion obtained was diluted by adding n-butyl alcohol thereto in an amount of 2 parts per part of the dispersion. The diluted dispersion was applied to the undercoat layer and dried by heating at 120° C. for 10 minutes to form a charge generating layer having a thickness of 0.2 μm.

Subsequently, a coating fluid obtained by dissolving 12 parts of the copolycarbonate represented by formula (B-1) used in Example 4 and 8 parts of triarylamine compound III-28 specified hereinabove as a charge transport material into 100 parts of monochlorobenzene was applied to the charge generating layer. The coating was dried by heating at 115° C. for 60 minutes to form a charge transport layer having a thickness of about 20 μm. The electrophotographic photoreceptor thus produced was examined for electrophotographic characteristics in the same manner as in Example 45. The results obtained are shown in Table 13.

EXAMPLE 49

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol, and 20 parts of butanol was applied to an aluminum substrate by dip coating. The coating was dried by heating at 150° C. for 10 minutes to form an undercoat layer having a thickness of 0.1 μm.

A mixture of 60 parts of dibromoanthanthrone (Monolite Red 2Y, manufactured by ICI) as a charge generating material, 40 parts of a poly(vinyl butyral) resin (S-Lec BM-1, manufactured by Sekisui Chemical Co., Ltd.), and 200 parts of cyclohexanone was subjected to a dispersion treatment for 3 hours with a sand mill employing glass beads having a diameter of 1 mm as a dispersing medium. The dispersion thus prepared was applied to the undercoat layer and dried by heating at 100° C. for 10 minutes to form a charge generating layer having a thickness of 0.1 μm.

Subsequently, a coating fluid obtained by dissolving 12 parts of the copolycarbonate represented by formula (B-1) used in Example 4 and 8 parts of triarylamine compound III-28 specified hereinabove as a charge transport material into 100 parts of monochlorobenzene was applied to the charge generating layer. The coating was dried by heating at 115° C. for 60 minutes to form a charge transport layer having a thickness of about 20 μm. The electrophotographic photoreceptor thus produced was examined for electrophotographic characteristics in the same manner as in Example 45. The results obtained are shown in Table 13.

EXAMPLE 50

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol, and 20 parts of butanol was applied to an aluminum substrate by dip coating. The coating was dried by heating at 150° C. for 10 minutes to form an undercoat layer having a thickness of 0.1 μm.

As a charge generating material was used bisbenzimidazolylperylene (a mixture of cis and trans isomers) which had been synthesized by the method described in JP-A-3-24059, purified by sublimation, and reduced to a pigment size through pulverization with a ball mill. A mixture of 60 parts of this charge generating material, 40 parts of a poly(vinyl butyral) resin (S-Lec BM-1, manufactured by Sekisui Chemical Co., Ltd.), and 200 parts of cyclohexanone was subjected to a dispersion treatment for 6 hours with a sand mill employing glass beads having a diameter of 1 mm as a dispersing medium. The dispersion thus prepared was applied to the undercoat layer and dried by heating at 100° C. for 10 minutes to form a charge generating layer having a thickness of 0.1 μm.

Subsequently, a coating fluid obtained by dissolving 12 parts of the copolycarbonate represented by formula (B-1) used in Example 4 and 8 parts of triarylamine compound III-28 specified hereinabove as a charge transport material into 100 parts of monochlorobenzene was applied to the charge generating layer. The coating was dried by heating at 115° C. for 60 minutes to form a charge transport layer having a thickness of about 20 μm. The electrophotographic photoreceptor thus produced was examined for electrophotographic characteristics in the same manner as in Example 45. The results obtained are shown in Table 13.

EXAMPLE 51

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol, and 20 parts of butanol was applied to an aluminum substrate by dip coating. The coating was dried by heating at 150° C. for 10 minutes to form an undercoat layer having a thickness of 0.1 μm.

A mixture of 90 parts of trigonal selenium (manufactured by Xerox Corp.) as a charge generating material, 10 parts of a poly(vinyl butyral) resin (S-Lec BM-S, manufactured by Sekisui Chemical Co., Ltd.), and 300 parts of n-butyl alcohol was agitated to disperse the charge generating material. The dispersion obtained was diluted by adding n-butyl alcohol thereto in an amount of 2 parts per part of the dispersion. The diluted dispersion was applied to the undercoat layer and dried by heating at 120° C. for 10 minutes to form a charge generating layer having a thickness of 0.2 μm.

Subsequently, a coating fluid obtained by dissolving 12 parts of the copolycarbonate represented by formula (A-1) used in Example 1, 6 parts of triarylamine compound III-28 specified hereinabove as a charge transport material, and 2 parts of benzidine compound IV-27 specified hereinabove as another charge transport material into 100 parts of monochlorobenzene was applied to the charge generating layer. The coating was dried by heating at 115° C. for 60 minutes to form a charge transport layer having a thickness of about 20 μm. The electrophotographic photoreceptor thus produced was examined for electrophotographic characteristics in the same manner as in Example 45. The results obtained are shown in Table 13.

EXAMPLE 52

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol, and 20 parts of butanol was applied to an aluminum substrate by dip coating. The coating was dried by heating at 150° C. for 10 minutes to form an undercoat layer having a thickness of 0.1 μm.

A mixture of 60 parts of dibromoanthanthrone (Monolite Red 2Y, manufactured by ICI) as a charge generating material, 40 parts of a poly(vinyl butyral) resin (S-Lec BM-1, manufactured by Sekisui Chemical Co., Ltd.), and 200 parts of cyclohexanone was subjected to a dispersion treatment for 3 hours with a sand mill employing glass beads having a diameter of 1 mm as a dispersing medium. The dispersion thus prepared was applied to the undercoat layer and dried by heating at 100° C. for 10 minutes to form a charge generating layer having a thickness of 0.1 μm.

Subsequently, a coating fluid obtained by dissolving 12 parts of the copolycarbonate represented by formula (A-1) used in Example 1, 6 parts of triarylamine compound III-28 specified hereinabove as a charge transport material, and 2 parts of benzidine compound IV-27 specified hereinabove as another charge transport material into 100 parts of monochlorobenzene was applied to the charge generating layer. The coating was dried by heating at 115° C. for 60 minutes to form a charge transport layer having a thickness of about 20 μm. The electrophotographic photoreceptor thus produced was examined for electrophotographic characteristics in the same manner as in Example 45. The results obtained are shown in Table 13.

EXAMPLE 53

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol, and 20 parts of butanol was applied to an aluminum substrate by dip coating. The coating was dried by heating at 150° C. for 10 minutes to form an undercoat layer having a thickness of 0.1 μm.

As a charge generating material was used bisbenzimidazolylperylene (a mixture of cis and trans isomers) which had been synthesized by the method described in JP-A-3-24059, purified by sublimation, and reduced to a pigment size through pulverization with a ball mill. A mixture of 60 parts of this charge generating material, 40 parts of a poly(vinyl butyral) resin (S-Lec BM-1, manufactured by Sekisui Chemical Co., Ltd.), and 200 parts of cyclohexanone was subjected to a dispersion treatment for 6 hours with a sand mill employing glass beads having a diameter of 1 mm as a dispersing medium. The dispersion thus prepared was applied to the undercoat layer and dried by heating at 100° C. for 10 minutes to form a charge generating layer having a thickness of 0.1 μm.

Subsequently, a coating fluid obtained by dissolving 12 parts of the copolycarbonate represented by formula (A-1) used in Example 1, 6 parts of triarylamine compound III-28 specified hereinabove as a charge transport material, and 2 parts of benzidine compound IV-27 specified hereinabove as another charge transport material into 100 parts of monochlorobenzene was applied to the charge generating layer. The coating was dried by heating at 115° C. for 60 minutes to form a charge transport layer having a thickness of about 20 μm. The electrophotographic photoreceptor thus produced was examined for electrophotographic characteristics in the same manner as in Example 45. The results obtained are shown in Table 13.

EXAMPLE 54

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol, and 20 parts of butanol was applied to an aluminum substrate by dip coating. The coating was dried by heating at 150° C. for 10 minutes to form an undercoat layer having a thickness of 0.1 μm.

A mixture of 90 parts of trigonal selenium (manufactured by Xerox Corp.) as a charge generating material, 10 parts of a poly(vinyl butyral) resin (S-Lec BM-S, manufactured by Sekisui Chemical Co., Ltd.), and 300 parts of n-butyl alcohol was agitated to disperse the charge generating material. The dispersion obtained was diluted by adding n-butyl alcohol thereto in an amount of 2 parts per part of the dispersion. The diluted dispersion was applied to the undercoat layer and dried by heating at 120° C. for 10 minutes to form a charge generating layer having a thickness of 0.2 μm.

Subsequently, a coating fluid obtained by dissolving 12 parts of the copolycarbonate represented by formula (B-1) used in Example 4, 6 parts of triarylamine compound III-28 specified hereinabove as a charge transport material, and 2 parts of benzidine compound IV-27 specified hereinabove as another charge transport material into 100 parts of monochlorobenzene was applied to the charge generating layer. The coating was dried by heating at 115° C. for 60 minutes to form a charge transport layer having a thickness of about 20 μm. The electrophotographic photoreceptor thus produced was examined for electrophotographic characteristics in the same manner as in Example 45. The results obtained are shown in Table 13.

EXAMPLE 55

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol, and 20 parts of butanol was applied to an aluminum substrate by dip coating. The coating was dried by heating at 150° C. for 10 minutes to form an undercoat layer having a thickness of 0.1 μm.

A mixture of 60 parts of dibromoanthanthrone (Monolite Red 2Y, manufactured by ICI) as a charge generating material, 40 parts of a poly(vinyl butyral) resin (S-Lec BM-1, manufactured by Sekisui Chemical Co., Ltd.), and 200 parts of cyclohexanone was subjected to a dispersion treatment for 3 hours with a sand mill employing glass beads having a diameter of 1 mm as a dispersing medium. The dispersion thus prepared was applied to the undercoat layer and dried by heating at 100° C. for 10 minutes to form a charge generating layer having a thickness of 0.1 μm.

Subsequently, a coating fluid obtained by dissolving 12 parts of the copolycarbonate represented by formula (B-1) used in Example 4, 6 parts of triarylamine compound III-28 specified hereinabove as a charge transport material, and 2 parts of benzidine compound IV-27 specified hereinabove as another charge transport material into 100 parts of monochlorobenzene was applied to the charge generating layer. The coating was dried by heating at 115° C. for 60 minutes to form a charge transport layer having a thickness of about 20 μm. The electrophotographic photoreceptor thus produced was examined for electrophotographic characteristics in the same manner as in Example 45. The results obtained are shown in Table 13.

EXAMPLE 56

A solution consisting of 10 parts of a zirconium compound (Orgatics ZC540, manufactured by Matsumoto Seiyaku K.K.), 1 part of a silane compound (A1110, manufactured by Nippon Unicar Co., Ltd.), 40 parts of isopropanol, and 20 parts of butanol was applied to an aluminum substrate by dip coating. The coating was dried by heating at 150° C. for 10 minutes to form an undercoat layer having a thickness of 0.1 μm.

As a charge generating material was used bisbenzimidazolylperylene (a mixture of cis and trans isomers) which had been synthesized by the method described in JP-A-3-24059, purified by sublimation, and reduced to a pigment size through pulverization with a ball mill. A mixture of 60 parts of this charge generating material, 40 parts of a poly(vinyl butyral) resin (S-Lec BM-1, manufactured by Sekisui Chemical Co., Ltd.), and 200 parts of cyclohexanone was subjected to a dispersion treatment for 6 hours with a sand mill employing glass beads having a diameter of 1 mm as a dispersing medium. The dispersion thus prepared was applied to the undercoat layer and dried by heating at 100° C. for 10 minutes to form a charge generating layer having a thickness of 0.1 μm.

Subsequently, a coating fluid obtained by dissolving 12 parts of the copolycarbonate represented by formula (B-1) used in Example 4, 6 parts of triarylamine compound III-28 specified hereinabove as a charge transport material, and 2 parts of benzidine compound IV-27 specified hereinabove as another charge transport material into 100 parts of monochlorobenzene was applied to the charge generating layer. The coating was dried by heating at 115° C. for 60 minutes to form a charge transport layer having a thickness of about 20 μm. The electrophotographic photoreceptor thus produced was examined for electrophotographic characteristics in the same manner as in Example 45. The results obtained are shown in Table 13.

TABLE 13

| | Charge generating layer | | Charge transport layer | | 1st | | | 1000th | | |
|---|---|---|---|---|---|---|---|---|---|---|
| | Charge generating material | Resin | Resin No. | Charge transport material No. | $V_o$ (V) | $E_{1/2}$ (lux · sec) | $V_{RP}$ (V) | $V_o$ (V) | $E_{1/2}$ (lux · sec) | $V_{RP}$ (V) |
| Example 45 | trigonal selenium | poly(vinyl butyral) | A-1 | III-28 | −810 | 0.9 | −19 | −815 | 1.0 | −23 |
| Example 46 | dibromoanthanthrone | " | A-1 | III-28 | −815 | 3.6 | −22 | −813 | 3.6 | −27 |
| Example 47 | bisbenzimidazolyl-perylene | " | A-1 | III-28 | −810 | 2.6 | −20 | −804 | 2.5 | −27 |
| Example 48 | trigonal selenium | " | B-1 | III-28 | −810 | 1.1 | −25 | −818 | 1.3 | −29 |
| Example 49 | dibromoanthanthrone | " | B-1 | III-28 | −820 | 3.7 | −31 | −816 | 3.7 | −37 |

TABLE 13-continued

| | Charge generating layer | | Charge transport layer | | 1st | | | 1000th | | |
|---|---|---|---|---|---|---|---|---|---|---|
| | Charge generating material | Resin | Resin No. | Charge transport material No. | $V_o$ (V) | $E_{1/2}$ (lux · sec) | $V_{RP}$ (V) | $V_o$ (V) | $E_{1/2}$ (lux · sec) | $V_{RP}$ (V) |
| Example 50 | bisbenzimidazolyl-perylene | " | B-1 | III-28 | −810 | 2.8 | −27 | −805 | 2.8 | −32 |
| Example 51 | trigonal selenium | " | A-1 | III-28/IV-27 3/1 | −805 | 1.0 | −21 | −809 | 1.2 | −25 |
| Example 52 | dibromoanthanthrone | " | A-1 | III-28/IV-27 3/1 | −810 | 3.6 | −23 | −815 | 3.9 | −28 |
| Example 53 | bisbenzimidazolyl-perylene | " | A-1 | III-28/IV-27 3/1 | −805 | 2.7 | −24 | −802 | 2.9 | −30 |
| Example 54 | trigonal selenium | " | B-1 | III-28/IV-27 3/1 | −810 | 1.2 | −26 | −814 | 1.4 | −30 |
| Example 55 | dibromoanthanthrone | " | B-1 | III-28/IV-27 3/1 | −815 | 3.7 | −32 | −819 | 3.9 | −37 |
| Example 56 | bisbenzimidazolyl-perylene | " | B-1 | III-28/IV-27 3/1 | −805 | 2.9 | −31 | −800 | 3.0 | −37 |

The electrophotographic photoreceptor of the present invention has the following effects. The binder resin and charge transport material used for forming the photosensitive layer are soluble in high-boiling solvents, because the binder resin comprises a copolycarbonate resin comprising repeating units represented by structural formulae (I) and (II) described hereinabove and because the charge transport material is either a triarylamine compound represented by structural formula (III) described hereinabove or a mixture thereof with a benzidine compound. The coating fluid never gels and is stable to attain excellent producibility. The photosensitive layer formed from this coating fluid has high resistance to wearing and corona discharge. Furthermore, use of a charge generating material selected from metal-free phthalocyanine, titanyl phthalocyanine, gallium phthalocyanine, chlorogallium phthalocyanine, hydroxygallium phthalocyanine, trigonal selenium, dibromoanthanthrone, and bisbenzimidazolylperylene enables the electrophotographic photoreceptor of the invention to have high durability. Namely, the photoreceptor employing such charge generating material, even when repeatedly used in a copier or printer over a prolonged time period, undergoes neither a trouble in the photosensitive layer nor a decrease in electrophotographic characteristics and can give copies of excellent image quality over long. As apparent from the comparisons given above, the electrophotographic photoreceptor of the present invention is highly stable to repeated use and has high printing durability.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor which comprises an electroconductive substrate and a photosensitive layer formed thereon, said photosensitive layer containing as a binder resin a copolycarbonate resin comprising a structural unit represented by formula (I)

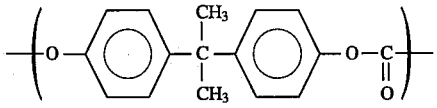

(I)

and a structural unit represented by formula (II)

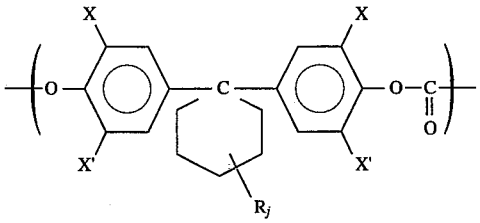

(II)

wherein X and X' each are a member selected from the group consisting of a hydrogen atom, a halogen atom and a methyl group; R is a member selected from the group consisting of a hydroxyl group, a carboxyl group, an acetyl group and an alkyl group having from 1 to 4 carbon atoms; and j means an integer of from 0 to 3, and further containing as a charge transport material a triarylamine compound represented by formula (III)

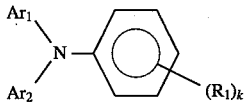

(III)

wherein $R_1$ is selected from the group consisting of a hydrogen atom and a methyl group; k is an integer of from 1 to 2; and $Ar_1$ and $Ar_2$ each are selected from the group consisting of an unsubstituted aryl group, and an aryl group substituted with a hydrogen atom, a halogen atom, an alkyl group, an alkoxy group or an amino group substituted by an alkyl group having 1 to 4 carbon atoms and at least one benzidine compound represented by formula (IV)

(IV)

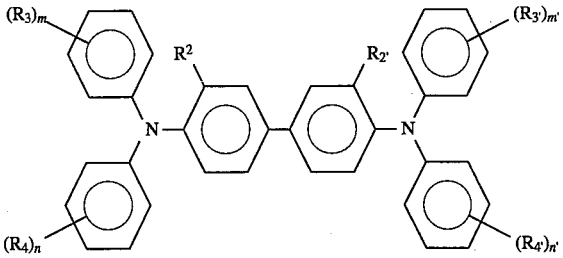

wherein $R_2$ and $R_2'$ are the same or different, and are selected from the group consisting of a hydrogen atom, an alkyl group, an alkoxy group, and a halogen atom; $R_3$, $R_3'$, $R_4$, and $R_4'$ are the same or different, and are selected from the group consisting of a hydrogen atom, an alkyl group, an alkoxy group, a halogen-substituted alkoxy group, a halogen atom and an amino group substituted by an alkyl group having 1 to 4 carbon atoms; and m, m'; n and n' are integers of from 1 to 2.

2. The electrophotographic photoreceptor as claimed in claim 1, wherein the repeating structural unit represented by formula (II) is represented by structural formula (II-1)

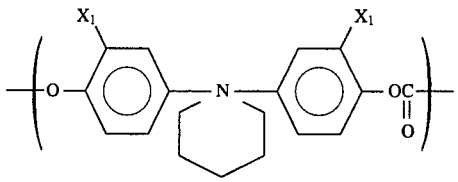

(II-1)

wherein $X_1$ is a member selected from the group consisting of a hydrogen atom and a methyl group.

3. The electrophotographic photoreceptor as claimed in claim 1, wherein the copolycarbonate resin has a molecular weight of 20,000 or higher in terms of viscosity-average molecular weight.

4. The electrophotographic photoreceptor as claimed in claim 1, wherein said photosensitive layer comprises an outermost layer containing the copolycarbonate resin having the repeating structural units represented by structural formulae (I) and (II).

5. The electrophotographic photoreceptor as claimed in claim 1, wherein said photosensitive layer contains at least one phthalocyanine pigment as a charge generating material.

6. The electrophotographic photoreceptor as claimed in claim 1, wherein the photosensitive layer contains at least one particulate selenium-based photoconductive material as a charge generating material.

7. The electrophotographic photoreceptor as claimed in claim 1, wherein the photosensitive layer contains at least one particulate anthanthrone pigment as a charge generating material.

8. The electrophotographic photoreceptor as claimed in claim 1, wherein said photosensitive layer contains at least one particulate perylene pigment as a charge generating material.

* * * * *